US009155672B2

(12) United States Patent
Farag et al.

(10) Patent No.: US 9,155,672 B2
(45) Date of Patent: Oct. 13, 2015

(54) ADJUSTABLE HEADREST FOR PATIENTS UNDERGOING SURGERY

(71) Applicant: The Cleveland Clinic Foundation, Cleveland, OH (US)

(72) Inventors: Ehad Farag, Solon, OH (US); Maged Argalious, Westlake, OH (US)

(73) Assignee: THE CLEVELAND CLINIC FOUNDATION, Cleveland, OH (US)

( * ) Notice: Subject to any disclaimer, the term of this patent is extended or adjusted under 35 U.S.C. 154(b) by 29 days.

(21) Appl. No.: 14/049,807

(22) Filed: Oct. 9, 2013

(65) Prior Publication Data

US 2014/0096322 A1 Apr. 10, 2014

Related U.S. Application Data

(60) Provisional application No. 61/117,537, filed on Oct. 9, 2012.

(51) Int. Cl.
*A47B 7/00* (2006.01)
*A61G 13/12* (2006.01)

(52) U.S. Cl.
CPC ..... *A61G 13/121* (2013.01)

(58) Field of Classification Search
CPC ..... A61G 13/121; A61G 7/072; A61G 7/07; A61B 19/203
USPC ..... 5/601, 622, 637, 640, 643; 128/845, 128/846
See application file for complete search history.

(56) References Cited

U.S. PATENT DOCUMENTS

| | | | | |
|---|---|---|---|---|
| 4,064,401 | A * | 12/1977 | Marden | 5/601 |
| 4,757,983 | A * | 7/1988 | Ray et al. | 5/637 |
| 6,594,839 | B1 * | 7/2003 | Papay | 5/637 |
| 7,306,612 | B1 * | 12/2007 | Landa | 606/130 |
| 7,882,583 | B2 * | 2/2011 | Skripps | 5/621 |
| 8,234,731 | B2 | 8/2012 | Skripps | |
| 8,281,434 | B2 | 10/2012 | Skripps | |
| 2006/0255220 | A1 * | 11/2006 | Skripps | 248/228.4 |
| 2012/0161489 | A1 | 6/2012 | Nam | |
| 2013/0205504 | A1 * | 8/2013 | Ratner | 5/622 |

* cited by examiner

*Primary Examiner* — Timothy D Collins
*Assistant Examiner* — Richard G Davis
(74) *Attorney, Agent, or Firm* — Tarolli, Sundheim, Covell & Tummino LLP

(57) ABSTRACT

A headrest assembly includes a frame, a first head support configured and dimensioned to support a forehead of a patient, and a second head support configured and dimensioned to support a chin of the patient. An adjustment mechanism is mounted to the frame and is operable to adjust the position of at least one of the first and second head supports relative to the frame. The first and second head supports having at least two degrees of freedom relative to a longitudinal plane and at least one degree of freedom relative to an axial plane that is orthogonal to the longitudinal plane. The longitudinal plane extends parallel to an X axis and also extends parallel to a Y axis that is orthogonal to the X axis. The axial plane extends parallel to one of the X axis and the Y axis. The axial plane also extends parallel to a Z-axis that is orthogonal to both the X axis and the Y axis.

15 Claims, 21 Drawing Sheets

ADJUSTABLE HEADREST FOR PATIENTS UNDERGOING SURGERY

RELATED APPLICATION

The present application claims the benefit of U.S. Provisional Patent Application Ser. No. 61/711,537, filed Oct. 9, 2012, the entirety of which is hereby incorporated by reference for all purposes.

TECHNICAL FIELD

The present invention relates generally to an apparatus for use in surgery and, more particularly, to an adjustable headrest assembly for use in surgeries where patients lie in the prone position.

BACKGROUND

Headrest assemblies are often used to hold and support a head of a patient during surgery. Such headrest assemblies typically include cushions for supporting the patient's forehead and chin. The cushions are often made from foam, which may cause abrasions to the patient during extended surgery. Headrest assemblies can also include mechanisms for adjusting the positions of the cushions based on the dimensions of the patient's head. Adjusting the cushion positions can be difficult and time-consuming, however, because of cumbersome headrest assembly configurations.

SUMMARY

The present invention is generally directed to an apparatus for use in surgery and, more particularly, to an adjustable headrest assembly for use in surgeries where patients lie in the prone position.

In a representative embodiment of the present invention, a headrest assembly comprises a frame, a first head support configured and dimensioned to support a forehead of a patient, and a second head support configured and dimensioned to support a chin of the patient. The headrest assembly also comprises an adjustment mechanism mounted to the frame and operable to adjust the position of at least one of the first and second head supports relative to the frame. The first and second head supports have at least two degrees of freedom relative to a longitudinal plane and at least one degree of freedom relative to an axial plane that is orthogonal to the longitudinal plane. The longitudinal plane extends parallel to an X axis and also extends parallel to a Y axis that is orthogonal to the X axis. The axial plane extends parallel to one of the X axis and the Y axis. The axial plane also extends parallel to a Z axis that is orthogonal to both the X axis and the Y axis.

In another embodiment of the present invention, a headrest assembly comprises a frame and a first head support configured to support a forehead of a patient. The first head support includes a first receptacle member, a first cushion disposed in the first receptacle member, and a first connecting bracket. The headrest assembly also comprises a second head support configured to support a chin of the patient. The second head support includes a second receptacle member, a second cushion disposed in the second receptacle member, and a second connecting bracket. The headrest assembly further comprises an adjustment mechanism mounted to the frame and operable to adjust the position of at least one of the first and second head supports relative to the frame. The first and second head supports have at least two degrees of freedom relative to a longitudinal plane and at least one degree of freedom relative to an axial plane that is orthogonal to the longitudinal plane. The longitudinal plane extends parallel to an X axis and also extends parallel to a Y axis that is orthogonal to the X axis. The axial plane extends parallel to one of the X axis and the Y axis. The axial plane also extends parallel to a Z-axis that is orthogonal to both the X axis and the Y axis. The first connecting bracket of the first head support joins the first receptacle member to the adjustment mechanism. The second connecting bracket of the second head support joins the second receptacle member to the adjustment mechanism. The adjustment mechanism includes a first bracket assembly operably connected to each of the first and second connecting brackets. The first bracket assembly is operable to effect translation of at least one of the first and second head supports in a direction parallel to the longitudinal plane. The adjustment mechanism also includes a second bracket assembly operably connected to the first bracket assembly. The second bracket assembly is operable to effect pivotal movement of the first and second head supports relative to the longitudinal plane. The adjustment mechanism further includes a third bracket assembly operably connected to the second bracket assembly. The third bracket assembly is operable to effect translation of the first and second head supports in a direction parallel to the axial plane.

In a further embodiment of the present invention, an adjustable headrest assembly is provided for use in surgery during which a patient lies in a prone position. The headrest assembly comprises a U-shaped frame having first and second segments joined together by an intermediate segment. The frame also has pivotable tabs to secure the headrest assembly to an external structure. The headrest assembly also comprises a forehead support and a chin support. Each of the forehead support and the chin support includes a receptacle member, a cushion disposed in the receptacle member, and a connecting bracket. The headrest assembly further comprises an adjustment mechanism mounted to the frame and attached to the connecting brackets of the forehead and chin supports. The adjustment mechanism is operable to adjust the position of the forehead and chin supports relative to the frame. The forehead and chin supports have at least two degrees of freedom relative to a longitudinal plane and at least one degree of freedom relative to an axial plane that is orthogonal to the longitudinal plane. The longitudinal plane extends parallel to an X axis and also extends parallel to a Y axis that is orthogonal to the X axis. The axial plane extends parallel to one of the X axis and the Y axis. The axial plane also extends parallel to a Z-axis that is orthogonal to both the X axis and the Y axis. The adjustment mechanism includes a first bracket assembly operable to effect translation of at least one of the forehead and chin supports in a direction parallel to the longitudinal plane. The first bracket assembly includes a first threaded shaft and a first control knob operably connected to the first threaded shaft. The adjustment mechanism also includes a second bracket assembly operably connected to the first bracket assembly and operable to effect pivotal movement of the forehead and chin supports relative to the longitudinal plane. The second bracket assembly includes a gear assembly and a second control knob operably connected to the gear assembly. The adjustment mechanism further includes a third bracket assembly operably connected to the second bracket assembly. The third bracket assembly is operable to effect translation of the forehead and chin supports in a direction parallel to the axial plane. The third bracket assembly includes a second threaded shaft, a third control knob operably connected to the second threaded shaft, and a movable brace member operably connected to the second bracket assembly.

BRIEF DESCRIPTION OF THE DRAWINGS

The foregoing and other features and advantages of the present invention will become apparent to one skilled in the art upon consideration of the following description of the invention and the accompanying drawings, in which.

DETAILED DESCRIPTION

Figure 1A:
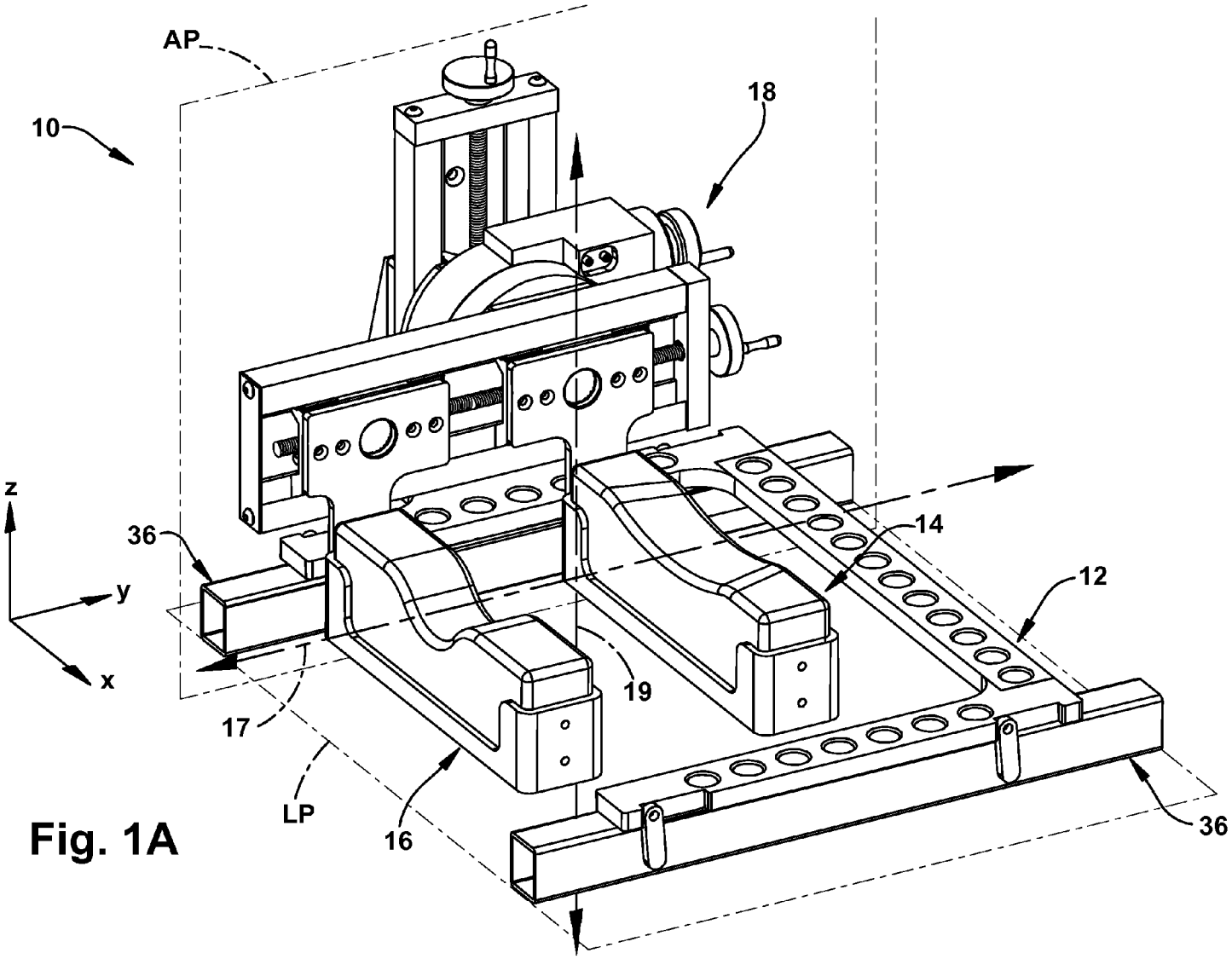
FIG. 1A is a perspective view showing a headrest assembly constructed in accordance with one aspect of the present invention.
Figure 1B:
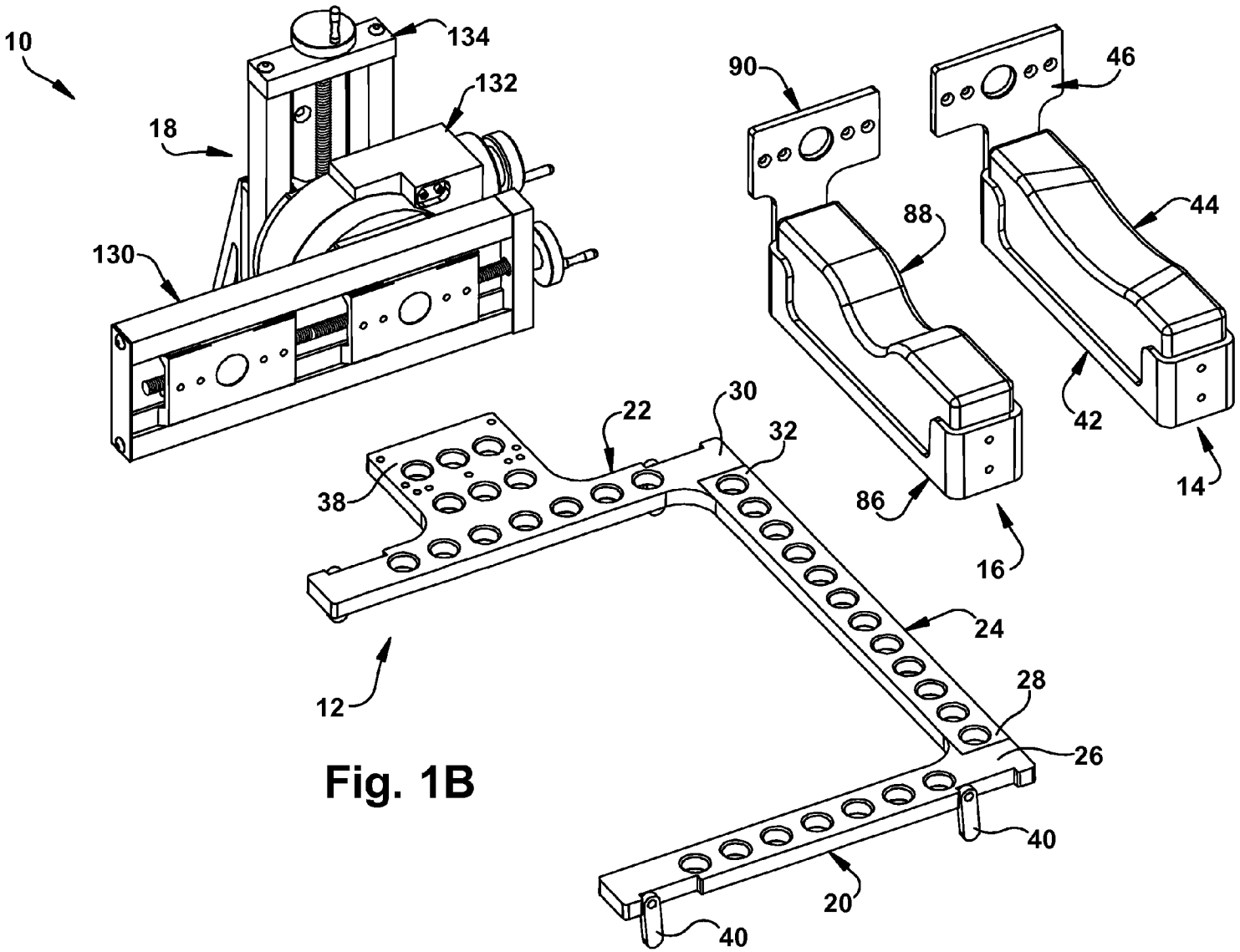
FIG. 1B is an exploded perspective view of the headrest assembly in FIG. 1A.
Figure 2A:
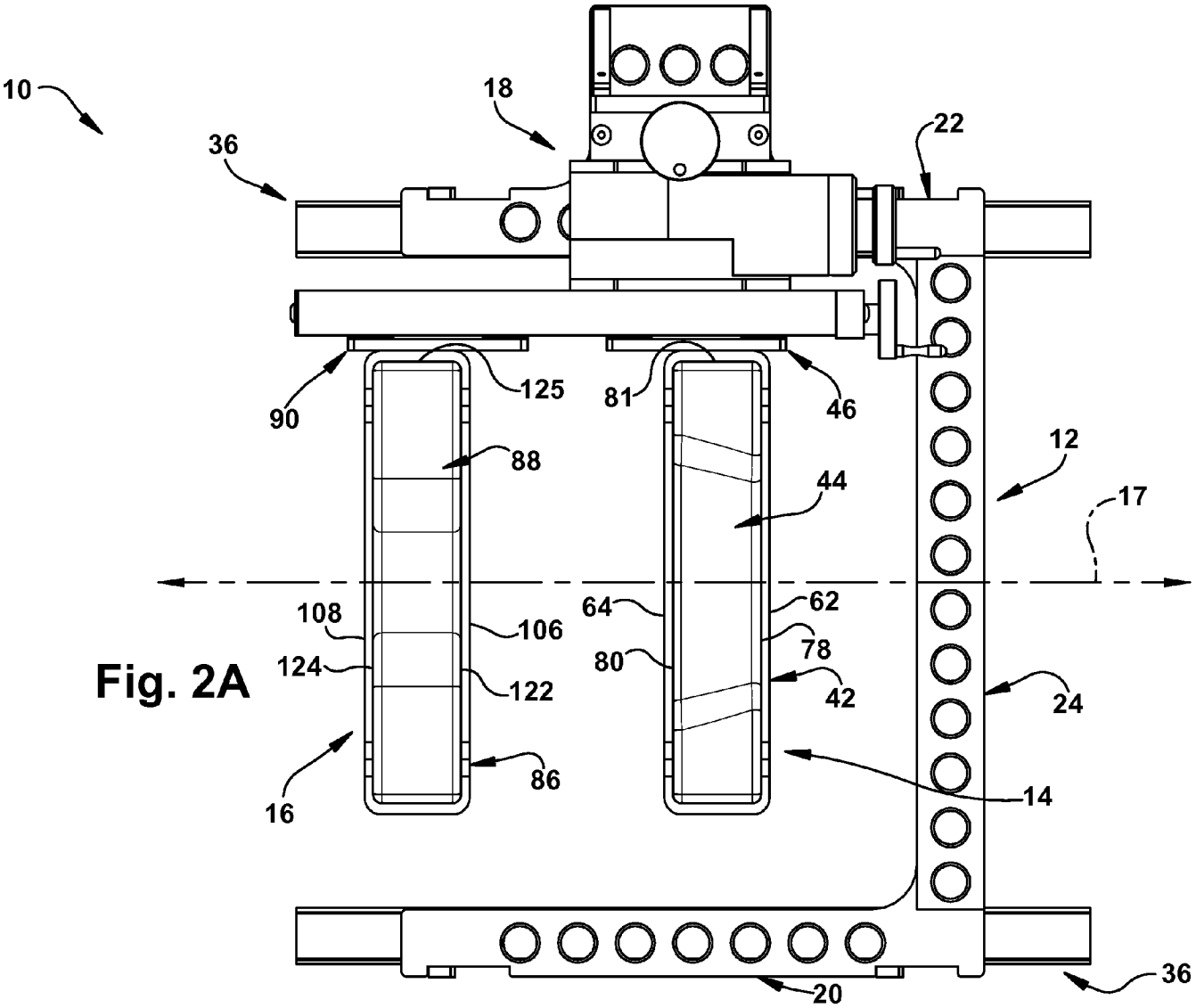
FIG. 2A is a top view of the headrest assembly in FIG. 1A.
Figure 2B:
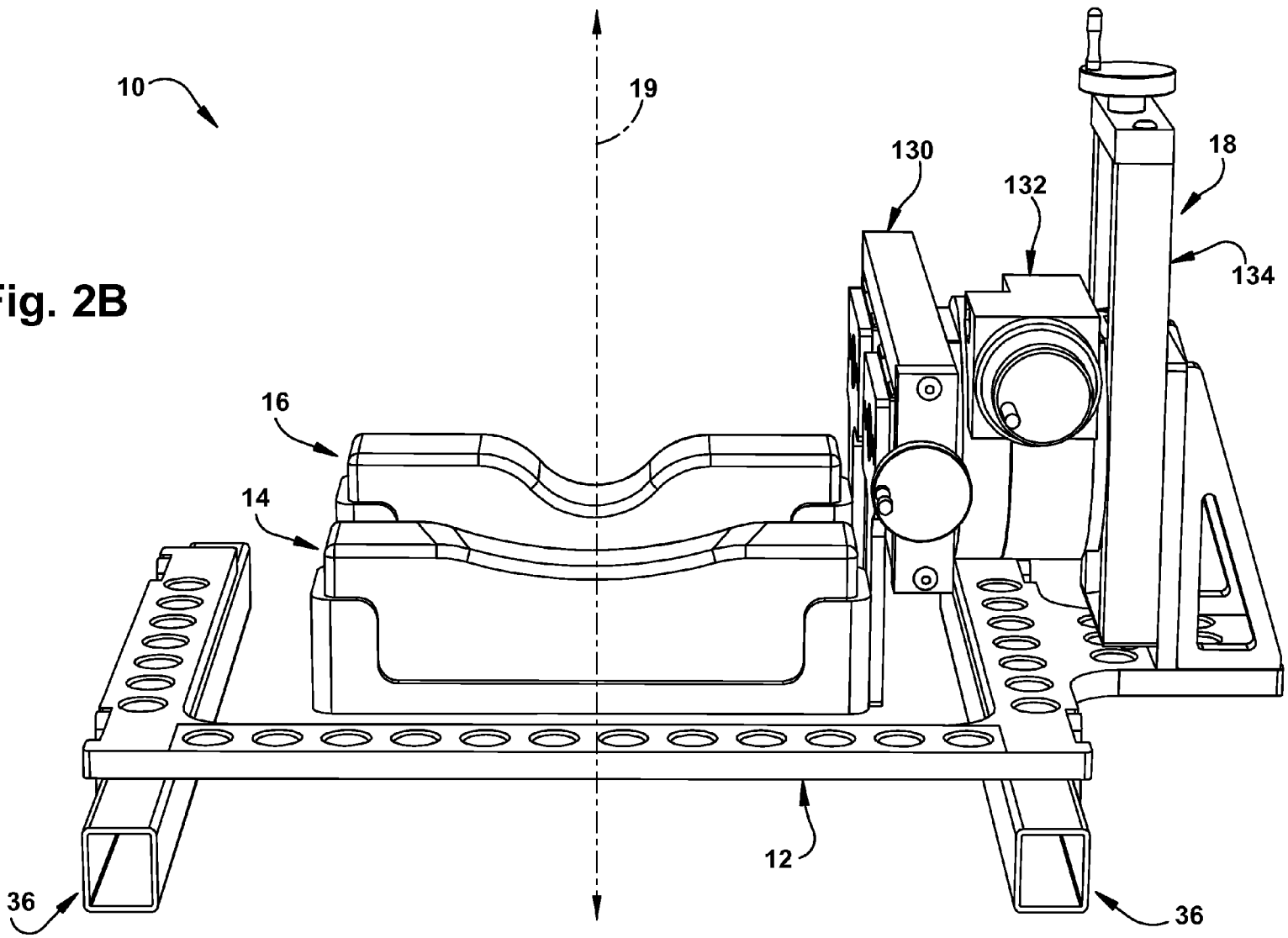
FIG. 2B is a perspective view of the headrest assembly in FIG. 1A from an end of the headrest assembly.

The present invention relates generally to an apparatus for use in surgery and, more particularly, to an adjustable headrest assembly for use in a surgery in which a patient lies in the prone position. As representative of one embodiment of the present invention, FIGS. 1A-B show a headrest assembly 10 comprising a frame 12, a first head support 14, a second head support 16, and an adjustment mechanism 18. The first and second head supports 14 and 16 may include cushions made of gel, which can reduce injury to the patient's head during extended surgery. In addition, as described in more detail below, the headrest assembly 10 of the present invention provides medical personnel with the ability to move a patient's head in multiple dimensions while the patient is in a prone position. By allowing for adjustment of the patient's head in multiple dimensions, the headrest assembly 10 helps to reduce the time needed to position the patient's head prior to surgery.

To provide a frame of reference for the movements of which the headrest assembly 10 is capable, FIG. 1A shows an X axis, a Y axis, and a Z axis, each of which axes is orthogonal to the other axes. Extending parallel to both the X axis and the Y axis is a longitudinal plane LP. Extending parallel to the longitudinal plane LP and to the Y axis is a central longitudinal axis 17 of the headrest assembly 10. Extending parallel to both the Y axis and the Z axis is a vertical or axial AP. Extending parallel to the axial plane AP and to the Z axis is a central vertical axis 19 of the headrest assembly 10. The first and second head supports 14 and 16 of the headrest assembly 10 have at least two degrees of freedom relative to the longitudinal plane LP and the central longitudinal axis 17 and at least one degree of freedom relative to the axial plane AP and the central vertical axis 19.

In the headrest assembly 10, the frame 12 (FIGS. 1B and 3) has a U-shaped configuration. In particular, the frame 12 includes a first segment 20 and a second segment 22 that is spaced apart from and extends parallel to the first segment. The first and second segments 20 and 22 are joined together by an intermediate segment 24. Specifically, the first segment 20 includes, at one end, a mating portion 26 that engages a first end 28 of the intermediate segment 24. Similarly, the second segment 22 includes, at one end, a mating portion 30 that engages a second end 32 of the intermediate segment 24. The first segment 20, the second segment 22, and the intermediate segment 24 are substantially coplanar with each other and, therefore, lie substantially within a plane that extends parallel to the longitudinal plane LP. With regard to the word "substantially," as used in the foregoing sentence and elsewhere in this description, "substantially" means as close to the stated condition as can reasonably and cost-effectively be achieved by reasonably available manufacturing and/or assembly processes and equipment. The first and second segments 20 and 22 have substantially equal lengths, widths, and thicknesses and, except for an attachment portion 38 described in more detail below, are mirror images of one another. The intermediate segment 24 may have a thickness that is substantially equal to the thicknesses of the first and second segments 20 and 22. The length and width of the intermediate segment 24 may also be the same as or similar to the lengths and widths of the first and second segments 20 and 22. As shown, the first segment 20, the second segment 22, and the intermediate segment 24 are generally rectangular in cross-section, but the first segment, the second segment, and/or the intermediate segment may have other shapes in cross-section, such as square, triangular, circular, or oval. Each of the first segment 20, the second segment 22, and the intermediate segment 24 includes one or more openings 34 that may reduce the weight of the frame 12 without adverse effect on the load-carrying capacity of the frame. The openings 34 may also be used to receive attachment devices, such as clamps or bolts, for releasably or permanently attaching the frame 12 to an external structure 36 (FIG. 1A), such as an operating table The second segment 22 includes an attachment portion 38 configured to engage and support a portion of the attachment mechanism 18. The attachment portion 38 can extend outward from, and be substantially coplanar with, the second segment 22. The attachment portion 38 has a thickness that is substantially equal to the thickness of each of the first segment 20, the second segment 22, and the intermediate segment 24. As shown, the attachment portion 38 has a square outer shape. It will be appreciated, however, that the attachment portion can have other outer shapes as well, such as rectangular or circular. In addition, while the attachment portion 38 is shown as being formed in one piece with the second segment 22 of the frame 12, the attachment portion 38 may be formed separately from the second segment 22 and subsequently attached to the second segment. Similarly, the attachment portion 38 may be formed as a portion of the first segment 20, rather than as a portion of the second segment 22.

Figure 3:
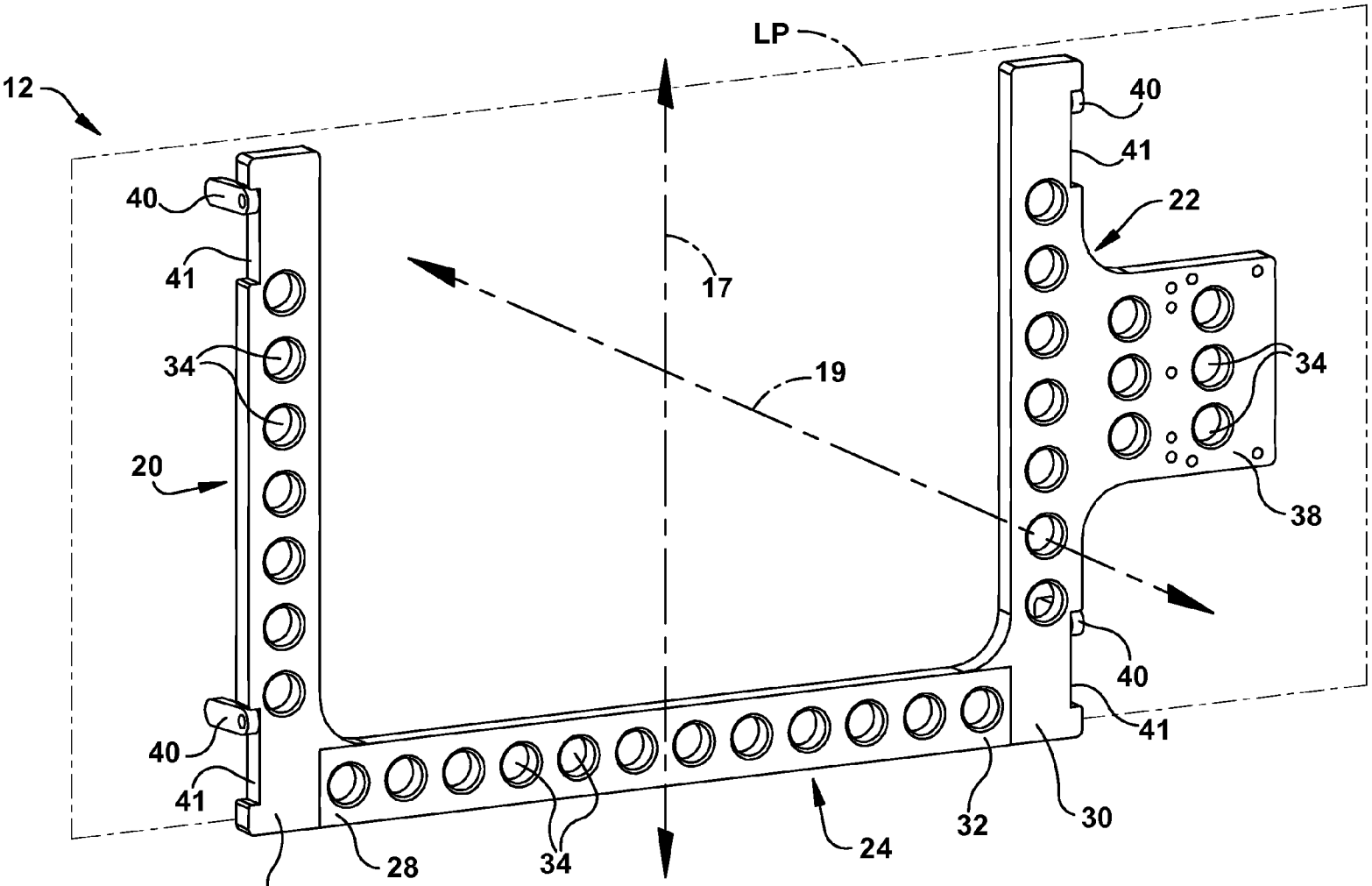
FIG. 3 is a perspective view showing a frame of the headrest assembly in FIGS. 1A-B.

Both of the first and second segments 20 and 22 include two attachment tabs 40. Each attachment tab 40 is mounted in a recess 41 formed in an edge of either the first segment 20 or the second segment 22. Each attachment tab 40 is attached to the first segment 20 or the second segment 22 with a fastener (e.g., a screw, bolt or pin) such that the attachment tab is rotatable or pivotable relative to the first or second segment. For example, an attachment tab 40 may be attached to the first segment 20 or the second segment 22 such that the attachment tab can be rotated or pivoted into a position in which the attachment tab extends perpendicular to the plane in which the first and second segments lie and perpendicular to the longitudinal plane LP, as shown in FIG. 3. Each attachment tab 40 is configured to contact or otherwise engage a portion of the external structure 36, as shown in FIG. 1A, and thereby to help secure the headrest assembly 10 to the external structure. The attachment tabs 40, as shown, have an elongate outer shape with rounded ends, but the attachment tabs may have other outer shapes, such as rectangular, circular, or elliptical.

Figure 4A:
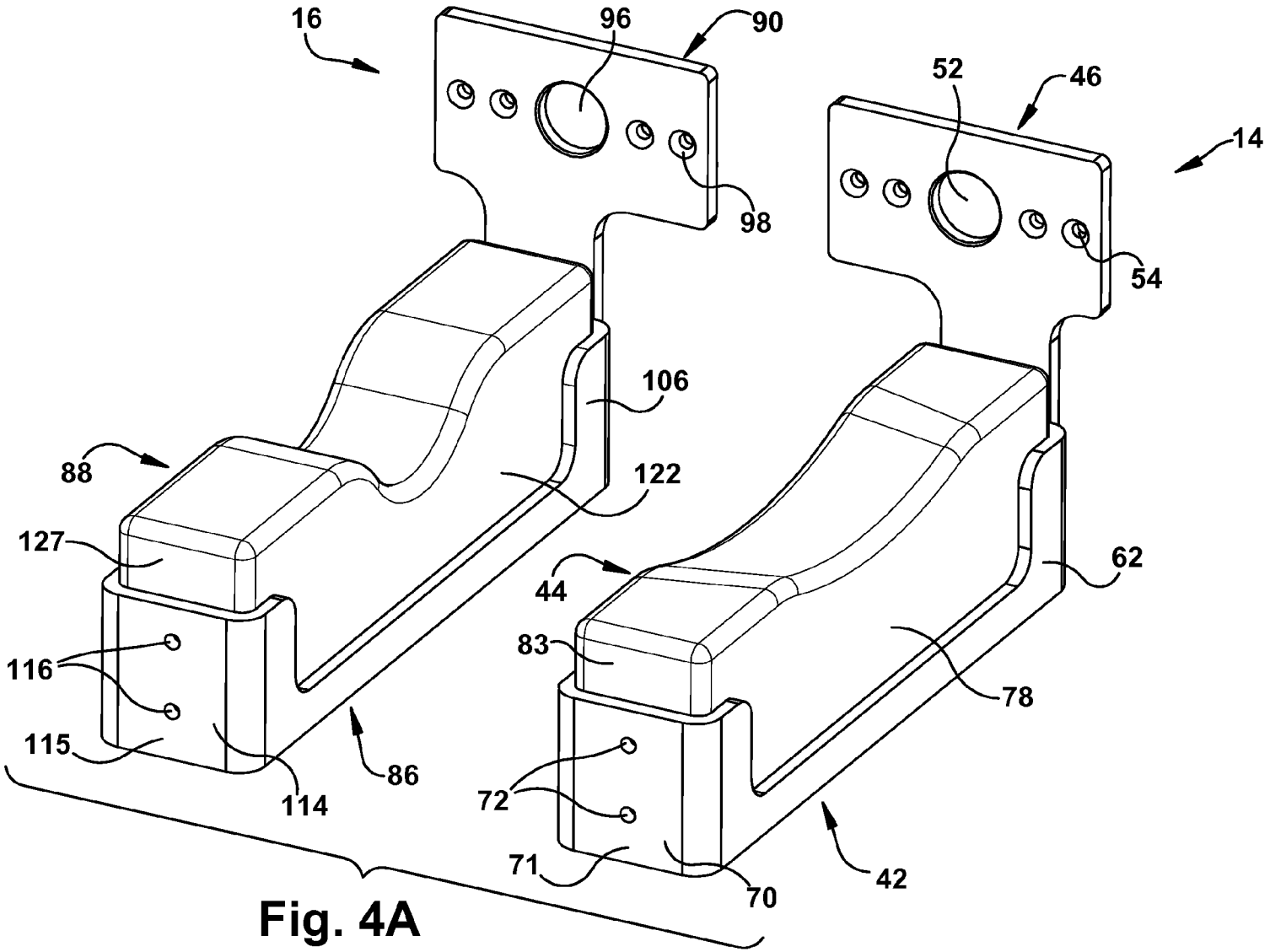
FIG. 4A is a perspective view of first and second head supports of the headrest assembly in FIGS. 1A-B.

The first head support 14 (best shown in FIGS. 4A and 4B) is configured and dimensioned to support the forehead of a patient. The first head support 14 includes a first receptacle 42, a first gel cushion 44 contoured to support the patient's forehead, and a first connecting bracket 46. The first connecting bracket 46 includes an upper portion 48 (FIG. 4B) and a lower portion 50. The upper portion 48 includes a relatively large diameter central opening 52 and four relatively small diameter fastener openings 54. Each of the fastener openings 54 is configured and dimensioned to receive a fastener (not shown) for attaching the first connecting bracket 46 to the adjustment mechanism 18. The lower portion 50 of the first connecting bracket 46 also includes two fastener openings 54 for attaching the first connecting bracket 46 to the first receptacle 42. The lower portion 50 of the first connecting bracket 46 is connected to the first receptacle 42 by fasteners (not shown), such as screws, bolts or pins, which extend through the fastener openings 54 in the lower portion. A first surface 56 of the first connecting bracket 46 is configured to engage a portion of the first receptacle 42. The first connecting bracket 46 also includes a second surface 58 that is disposed opposite the first surface 56 and that is configured to engage a portion of the adjustment mechanism 18.

Figure 4B:
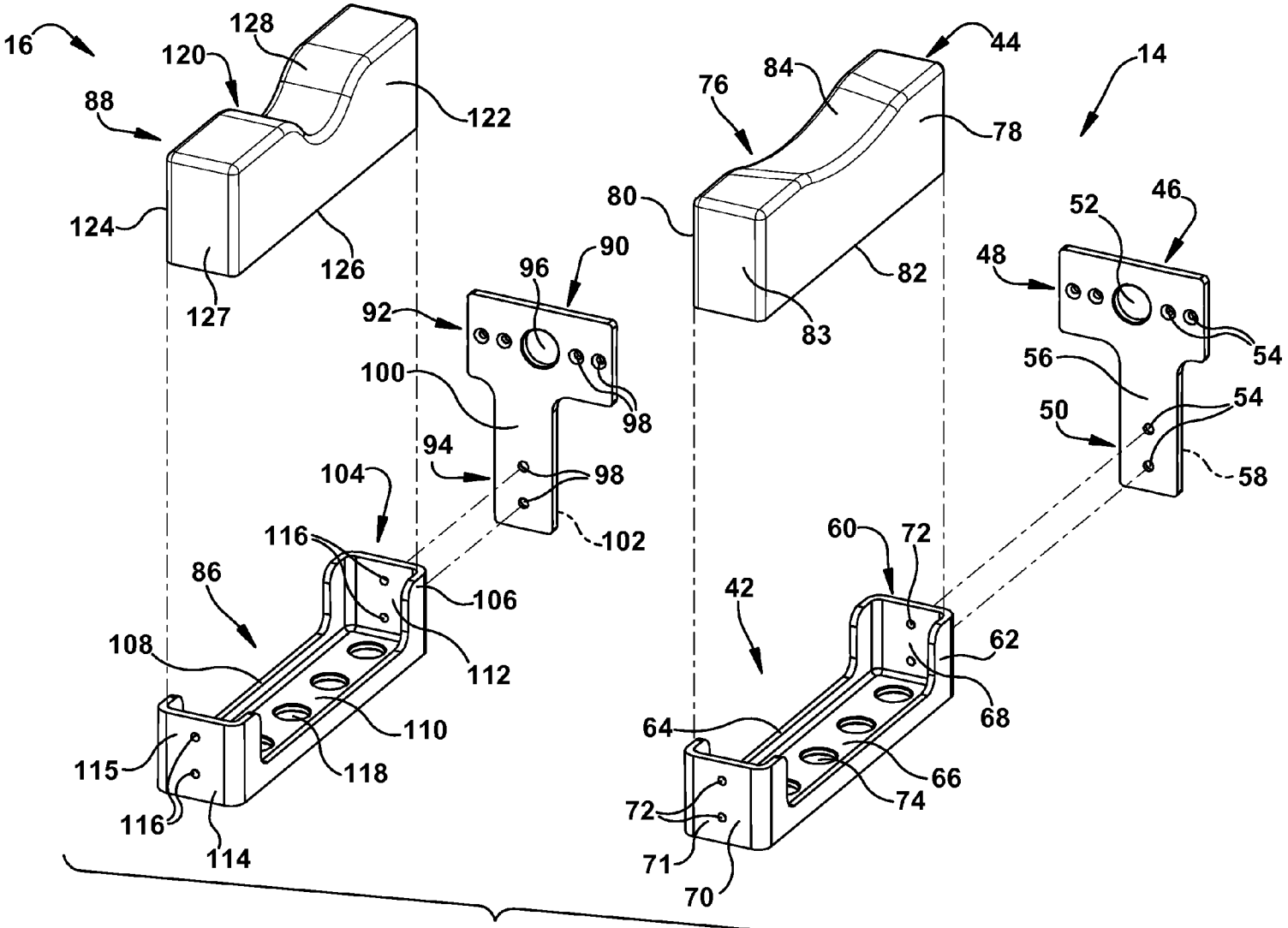
FIG. 4B is an exploded perspective view of the first and second head supports in FIG. 4A.

The first receptacle 42 receives and supports the first gel cushion 44. The first receptacle includes a main body 60 that supports the first gel cushion 44. The main body 60 includes first and second vertical side portions 62 and 64 that extend parallel to each other and that are spaced apart from each other. The first and second vertical side portions 62 and 64 are joined together by a horizontal bottom portion 66. The first and second vertical side portions 62 and 64 are also joined together by first and second vertical end portions 68 and 70. The first and second vertical end portions 68 and 70 extend parallel to each other and are spaced apart from each another by the length of the horizontal bottom portion 66. In one example, as shown in FIG. 4B, the first and second vertical side portions 62 and 64 have a U-shaped configuration, which gives a U-shaped configuration to the first receptacle 42. The first and second vertical side portions 62 and 64 have substantially equal lengths, widths, and thicknesses. The first vertical end portion 68 includes a mating surface that contacts or otherwise engages the first surface 56 of the first connecting bracket 46. The second vertical end portion 70 includes a front surface 71 that is free from contact or other engagement with any other component of the headrest assembly 10.

The horizontal bottom portion 66 can have a length and thickness that are substantially equal to the length and thickness of the first and second vertical side portions 62 and 64. The first and second vertical end portions 68 and 70 include fastener openings 72, each of which is configured to receive a fastener (not shown), e.g., a screw, bolt or pin, for attaching the first or second vertical end portion to the first connecting bracket 46. Despite the existence of the fastener openings 72 in both of the first and second vertical end portions 68 and 70, only the first vertical end portion 68 is in contact with the first connecting bracket 46. Additionally, the horizontal bottom portion 66 can include openings 74 to help, for example, reduce the weight of the first receptacle 42.

The first gel cushion 44 includes a main body 76 configured to support the forehead of a patient. The main body 76 includes first and second side surfaces 78 and 80, first and second end surfaces 81 and 83, a lower surface 82, and a contoured upper surface 84. In one embodiment, as shown in FIG. 4B, the upper surface 84 has a U-shaped, arcuate, or wave-shaped configuration. The first and second side surfaces 78 and 80 engage the first and second vertical side portions 62 and 64, respectively, of the first receptacle 42 when the first gel cushion 44 is received in the first receptacle. Each of the first and second side surfaces 78 and 80 has a length that is equal to or slightly less than the length of each of the first and second vertical side portions 62 and 64. The first and second side surfaces 78 and 80 have a height that is greater than the height of the first and second vertical side portions 62 and 64. The lower surface 82 of the first gel cushion 44 contacts or otherwise engages the horizontal bottom portion 66 of the first receptacle 42. The lower surface 82 can have a length and width that is equal to or slightly less than the length and width of the horizontal bottom portion 66. The first and second end surfaces 81 and 83 engage the first and second vertical end portions 68 and 70, respectively, of the first receptacle 42 when the first gel cushion 44 is received in the first receptacle. Each of the first and second end surfaces 81 and 83 has a length that is equal to or slightly less than the length of each of the first and second vertical end portions 68 and 70. The first and second end surfaces 81 and 83 have a height that is greater than the height of the first and second vertical end portions 68 and 70. The first gel cushion 44 can have a substantially rectangular outer shape when viewed from an end of the first gel cushion, but it will be appreciated that other shapes are possible.

The second head support 16 is configured and dimensioned to support the chin of a patient. The second head support 16 includes a second receptacle 86, a second gel cushion 88 contoured to support the patient's chin, and a second connecting bracket 90. The second connecting bracket 90 includes an upper portion 92 (FIG. 4B) and a lower portion 94. The upper portion 92 includes a relatively large diameter central opening 96 and four relatively small diameter fastener openings 98. Each of the fastener openings 98 is configured and dimensioned to receive a fastener (not shown) for attaching the second connecting bracket 90 to the adjustment mechanism 18. The lower portion 94 also includes two fastener openings 98 for attaching the second connecting bracket 90 to the second receptacle 86. The lower portion 94 of the second connecting bracket 90 is connected to the second receptacle 86 by fasteners (not shown), such as screws, bolts or pins, which extend through the fastener openings 98 in the lower portion. A first surface 100 of the second connecting bracket 90 is configured to engage a portion of the second receptacle 86. The second connecting bracket 90 also includes a second surface 102 that disposed opposite the first surface 100 and that is configured to engage a portion of the adjustment mechanism 18.

The second receptacle 86 receives and supports the second gel cushion 88. The second receptacle 86 includes a main body 104 that supports the second gel cushion 88. The main body 104 includes first and second vertical side portions 106 and 108 that extend parallel to each other and that are spaced apart from each other. The first and second vertical side portions 106 and 108 are joined together by a horizontal bottom portion 110. The first and second vertical side portions 106 and 108 are also joined together by first and second vertical end portions 112 and 114. The first and second vertical end portions 112 and 114 extend parallel to each other and are spaced apart from each another by the length of the horizontal bottom portion 110. In one example, as shown in FIG. 4B, the first and second vertical side portions 106 and 108 have a U-shaped configuration, which gives a U-shaped configuration to the second receptacle 86. The first and second vertical side portions 106 and 108 have substantially equal lengths, widths, and thicknesses. The first vertical end portion 112 includes a mating surface that contacts or otherwise engages the first surface 100 of the second connecting bracket 90. The second vertical end portion 114 includes a front surface 115 that is free from contact or other engagement with any other component of the headrest assembly 10.

The horizontal bottom portion 110 can have a length and thickness that are substantially equal to the length and thickness of the first and second vertical side portions 106 and 108. The first and second vertical end portions 112 and 114 include fastener openings 116, each of which is configured to receive a fastener (not shown), e.g., a screw, bolt or pin, for attaching the first or second vertical end portion to the second connecting bracket 90. Despite the existence of the fastener openings 116 in both of the first and second vertical end portions 112 and 114, only the first vertical end portion 112 is in contact with the second connecting bracket 90. Additionally, the horizontal bottom portion 110 can include openings 118 to help, for example, reduce the weight of the second receptacle 86.

The second gel cushion 88 includes a main body 120 configured to support the forehead of a patient. The main body 120 includes first and second side surfaces 122 and 124, first and second end surfaces 125 and 127, a lower surface 126, and a contoured upper surface 128. In one embodiment, as shown in FIG. 4B, the upper surface 128 has a U-shaped, arcuate, or wave-shaped configuration. The first and second side surfaces 122 and 124 engage the first and second vertical side portions 106 and 108, respectively, of the second receptacle 86 when the second gel cushion 88 is received in the first receptacle. Each of the first and second side surfaces 122 and 124 has a length that is equal to or slightly less than the length of each of the first and second vertical side portions 106 and 108. The first and second side surfaces 122 and 124 have a height that is greater than the height of the first and second vertical side portions 106 and 108. The lower surface 126 of the second gel cushion 88 contacts or otherwise engages the horizontal bottom portion 66 of the second receptacle 86. The lower surface 126 can have a length and width that is equal to or slightly less than the length and width of the horizontal bottom portion 110. The first and second end surfaces 125 and 127 engage the first and second vertical end portions 112 and 114, respectively, of the second receptacle 86 when the second gel cushion 88 is received in the second receptacle. Each of the first and second end surfaces 125 and 127 has a length that is equal to or slightly less than the length of each of the first and second vertical end portions 112 and 114. The first and second end surfaces 125 and 127 have a height that is greater than the height of the first and second vertical end portions 112 and 114. The second gel cushion 88 can have a substantially rectangular outer shape when viewed from an end of the first gel cushion, but it will be appreciated that other shapes are possible.

The adjustment mechanism 18 (FIGS. 5A-B) is securely mounted to the frame 12. The adjustment mechanism 18 includes a first bracket assembly 130, a second bracket assembly 132, and a third bracket assembly 134. The adjustment mechanism 18 is configured to adjust the position of the first head support 14 and/or the second head support 16 relative to the longitudinal and axial planes LP and AP and the central longitudinal axis 17 and the central vertical axis 19.

Figure 6A:
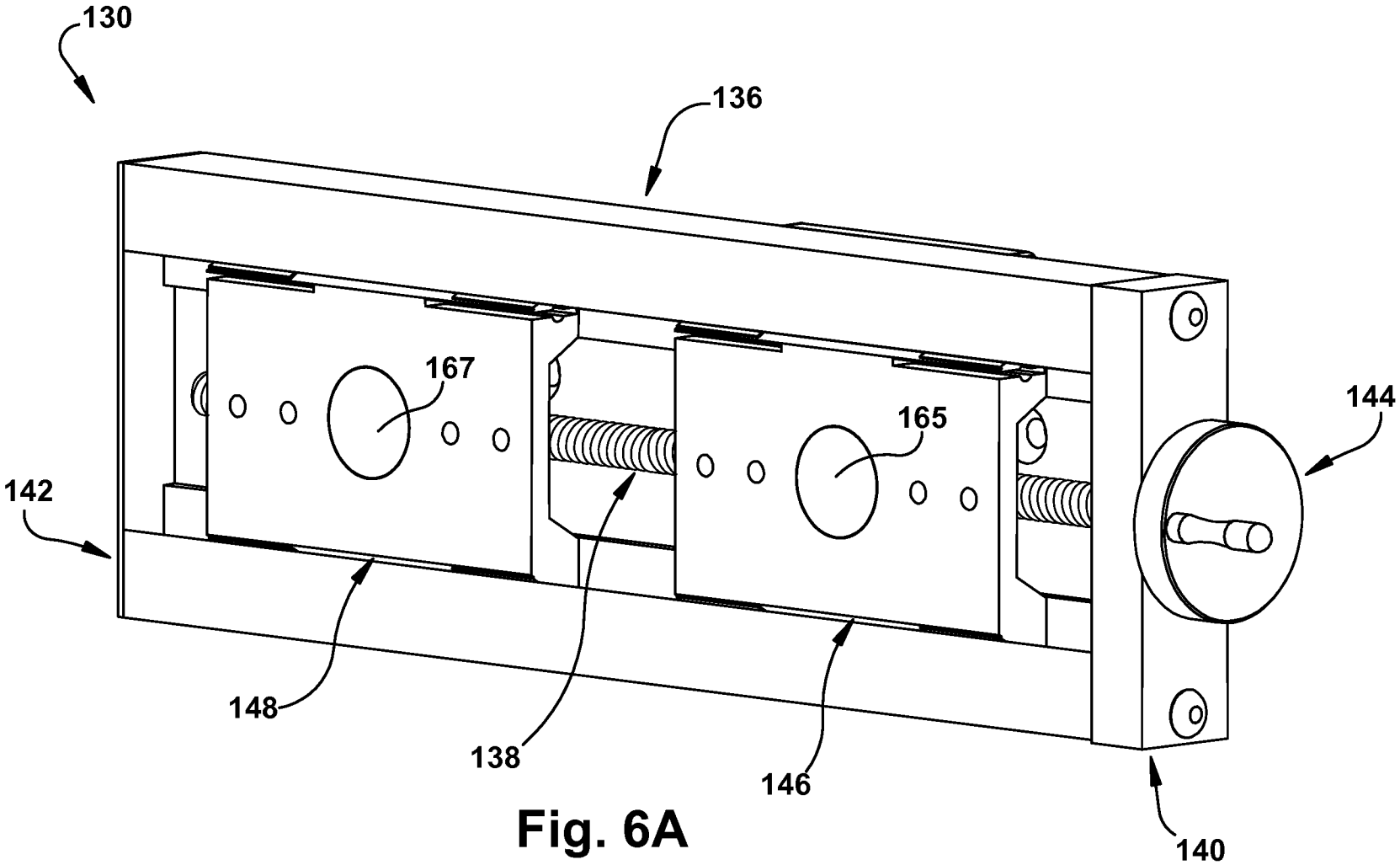
FIG. 6A is a perspective view of a first bracket assembly included in the adjustment mechanism of FIGS. 5A-B.
Figure 6B:
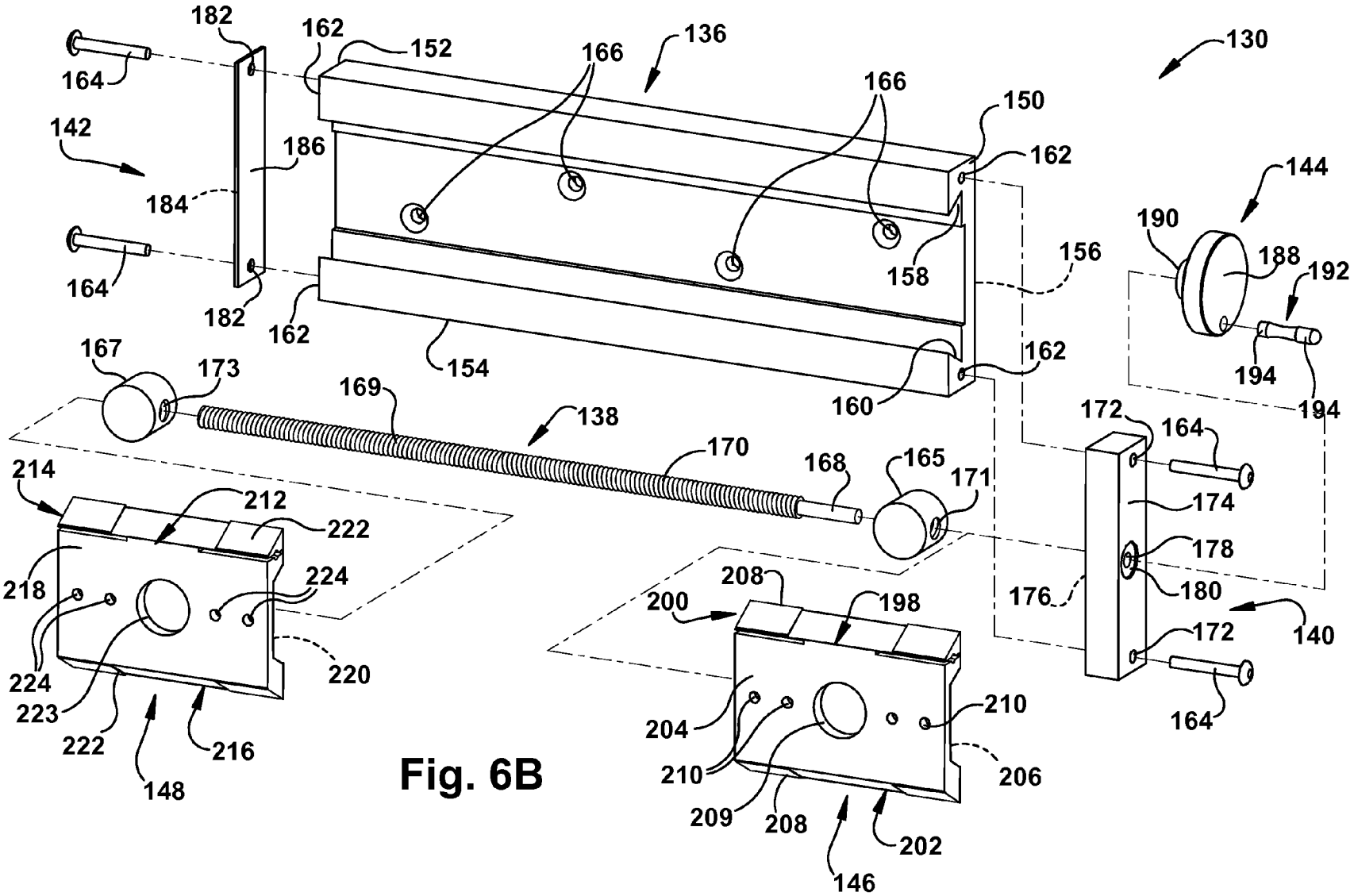
FIG. 6B is an exploded perspective view of the first bracket assembly of FIG. 6A.

The first bracket assembly 130 is operable to effect or cause translation of one or both of the first and second head supports 14 and 16 in a direction parallel to the longitudinal plane LP and the central longitudinal axis 17. The first bracket assembly 130 is operably connected to both of the first and second connecting brackets 46 and 90 of the first and second head supports 14 and 16, respectively. The first bracket assembly 130 (FIG. 6A-B) includes a main body 136, a first threaded shaft 138, a first end plate 140, a second end plate 142, a first control knob 144, a first moveable brace 146, and a second moveable brace 148.

The main body 136 (FIG. 6B) has a rectangular shape, but other shapes (e.g., square, oval or circular) are possible. The main body 136 includes a first end 150, an oppositely disposed second end 152, a front surface 154, and a back surface 156. The first end 150 is configured to engage the first end plate 140, and the second end 152 is configured to engage the second end plate 142. Each of the first end 150 and the second end 152 includes openings 162 configured and dimensioned to receive fasteners 164 (e.g., screws, bolts or pins). The front surface 154 includes first and second grooves 158 and 160 configured and dimensioned to receive and engage edges of the first and second moveable braces 146 and 148. The front surface 154 is also configured to contact and provide a slide surface for first and second cylindrical slide elements 165 and 167 that engage and move along the first threaded shaft 138. The back surface 156 of the main body 136 is configured to engage a portion of the second bracket assembly 132. The main body 136 further includes one or more openings 166 extending through the main body from the front surface 154 to the back surface 156. Each of the openings 166 is configured and dimensioned to receive a fastener (not shown) for connecting the main body 136 to a portion of the second bracket assembly 132.

The first threaded shaft 138 has an elongated cylindrical shape and is disposed along and substantially parallel to the front surface 154 of the main body 136. The first threaded shaft 138 includes a relatively short first end portion 168 and a substantially longer second end portion 170. The first end portion 168 has an outer diameter that is less than an outer diameter of the second end portion 170. The first end portion 168 is configured and dimensioned to extend through the first end plate 140 and engage the first control knob 144 such that the first end portion is operably connected to the first control knob. The second end portion 170 has an external threaded surface 169. As shown, the external threaded surface 169 has a right-hand thread over approximately one-half of its length and a left-hand thread over the other half of its length. The second end portion 170 extends through openings 171 and 173 in the first and second cylindrical slide elements 165 and 167, respectively. The openings 171 and 173 in the first and second cylindrical slide elements 165 and 167 are defined by internal threaded surfaces (not shown) of the first and second cylindrical slide elements.

The external threaded surface 169 of the second end portion 170 of the first threaded shaft 138 engages the internal threaded surfaces (not shown) of the first and second cylindrical slide elements 165 and 167. More particularly, one the first and second cylindrical slide elements 165 and 167 engages the right-hand thread portion of the external threaded surface 169 and the other of the first and second cylindrical slide elements engages the left-had thread portion of the external threaded surface. Rotation of the first threaded shaft 138 about its central longitudinal axis thus effects or causes movement of first and second cylindrical slide elements 165 and 167 along the length of the second end portion 170 of the first threaded shaft toward each other or away from each other. As a result of the first end portion 168 of the first threaded shaft 138 being operably connected to the first control knob 144, the first threaded shaft rotates about its central longitudinal axis in response to rotation of the first control knob.

The first end plate 140 is configured to engage the first end 150 of the main body 136. The first end plate 140 has a rectangular outer shape, but it will be appreciated that other shapes are possible (e.g., square, oval or circular). The first end plate 140 includes one or more fastener openings 172, each of which extends through the first end plate from a first surface 174 of the first end plate to an opposite, parallel second surface 176 of the first end plate. Between them, the first and second surfaces 174 and 176 define the thickness of the first end plate 140. Each of the fastener openings 172 is configured and dimensioned to receive one of the fasteners 164. Each of the fasteners 164 extends through the fastener openings 172 into the openings 162 in the first end 150 of the main body 136 to join the first end plate 140 with the main body. The first end plate 140 also includes a central opening 178 that extends through the first end plate from the first surface 174 to the second surface 176. The central opening 178 is configured and dimensioned to receive the first end portion 168 of the first threaded shaft 138. A portion of the first surface 174 surrounding the central opening 178 includes a depression 180, which receives a portion of the first control knob 144.

The second end plate 142 is configured to engage the second end 152 of the main body 136. The second end plate 142 has a rectangular outer shape, but it will be appreciated that other shapes are possible (e.g., square, oval or circular). The second end plate 142 includes one or more fastener openings 182, each of which extends through the second end plate from a first surface 184 of the second end plate to an opposite, parallel second surface 186 of the second end plate. Between them, the first and second surfaces 184 and 186 define the thickness of the second end plate 142. Each of the fastener openings 182 is configured and dimensioned to receive one of the fasteners 164. Each of the fasteners 164 extends through the fastener openings 182 into the openings 162 of the second end 152 of the main body 136 to join the second end plate 142 with the main body.

The first control knob 144 includes a top portion 188, a bottom portion 190, and a first handle 192 attached to the top portion. The first handle 192 includes a top portion 194 and a bottom portion 196. The bottom portion 196 of the first handle 192 is attached to the top portion 188 of the first control knob 144. The bottom portion 190 of the first control knob 144 has a circular cross-sectional profile and is configured to fit snugly within the depression 180 surrounding the central opening 178 in the first end plate 140. The bottom portion 190 of the first control knob 144 also includes an elongated internal surface (not shown) that defines a passage to receive the first end portion 168 of the first threaded shaft 138 such that the first control knob is non-rotatably attached to and can rotate the first threaded shaft. The attachment of the first control knob 144 to the first end portion 168 of the first threaded shaft 138 can be obtained via a force fit, an adhesive, a set screw, or any other appropriate mechanism or technique. The first control knob 144 is thus operably connected to the first threaded shaft 138.

The first moveable brace 146 includes a main body portion 198 that has a generally rectangular shape. The main body portion 198 has a longer dimension that extends in a direction parallel to the longitudinal plane LP and the central longitudinal axis 17 and a shorter dimension that extends in a direction parallel to the axial plane AP and the central vertical axis 19. Oppositely disposed upper and lower engagement portions 200 and 202 of the first moveable brace 146 extend along upper and lower longitudinal edges of the main body portion 198 and are spaced apart by the shorter dimension of the rectangularly shaped main body portion. The upper engagement portion 200 can flex or pivot about a longitudinal axis relative to the main body portion 198. The main body portion 198 has a flattened or planar configuration and includes oppositely disposed first and second major surfaces 204 and 206. The first major surface 204 is presented toward the first connecting bracket 46. The second major surface 206 is presented toward the main body 136. Each of the upper and lower engagement portions 200 and 202 has a parallelogram-shaped cross-sectional profile and is thicker than the main body portion 198. Consequently, the first moveable brace 146 has a generally U-shaped profile when viewed in cross section taken orthogonal to the length of the first moveable brace 146.

The parallelogram-shaped cross-sectional profile of the upper and lower engagement portions 200 and 202 also results in a longitudinal surface of each of the upper and lower engagement portions extending at an angle or slope with respect to the adjacent first major surface 204 of the main body portion 198. The upper and lower engagement portions 200 and 202 are thus configured to be received and retained within the first and second grooves 158 and 160 of the main body 136. Although the first and second grooves 158 and 160 and the upper and lower engagement portions 200 and 202 are shown with complementary angled or sloped surfaces, other complementary shapes or configurations of the grooves and the upper and lower engagement portions are possible to allow the upper and lower engagement portions to be received and retained in the grooves. As can be seen, each of the upper and lower engagement portions 200 and 202 includes two, spaced apart, raised mating portions 208. The raised mating portions 208 contact the surfaces of the main body 136 inside the first and second grooves 158 and 160 and thereby reduce the extent to which the upper and lower engagement portions 200 and 202 contact those surfaces. The upper and lower engagement portions 200 and 202 are thus configured to slide within the first and second grooves 158 and 160, respectively, of the main body 136. The first moveable brace 146 is thereby slidably mounted in the first bracket assembly 130.

The main body portion 198 of the first moveable brace 146 includes a relatively large diameter central opening 209 that is dimensioned to receive a portion of the first cylindrical slide element 165 so that the main body portion 198 and the first moveable brace 146 move together with the first slide element. The main body portion 198 also includes smaller diameter fastener openings 210 that extend through the main body portion from the first major surface 204 to the second major surface 206. The fastener openings 210 are configured and dimensioned to receive fasteners (not shown) that extend into the fastener openings 54 in the upper portion 48 of the first connecting bracket 46 to mount the first connecting bracket to the first moveable brace 146. The main body portion 198 may include a raised mating portion (not shown) that extends from the first major surface 204. The raised mating portion may be shaped and dimensioned to fit within or mate with the central opening 52 of the first connecting bracket 46 of the first head support 14. In one example, the raised mating portion may have a dome-like configuration The second moveable brace 148 includes a main body portion 212 that has a generally rectangular shape. The main body portion 212 has a longer dimension that extends in a direction parallel to the longitudinal plane LP and the central longitudinal axis 17 and a shorter dimension that extends in a direction parallel to the axial plane AP and the central vertical axis 19. Oppositely disposed upper and lower engagement portions 214 and 216 of the second moveable brace 148 extend along upper and lower longitudinal edges of the main body portion 212 and are spaced apart by the shorter dimension of the rectangularly shaped main body portion. The upper engagement portion 214 can flex or pivot about a longitudinal axis relative to the main body portion 212. The main body portion 212 has a flattened or planar configuration and includes oppositely disposed first and second major surfaces 218 and 220. The first major surface 218 is presented toward the second connecting bracket 90. The second major surface 206 is presented toward the main body 136. Each of the upper and lower engagement portions 214 and 216 has a parallelogram-shaped cross-sectional profile and is thicker than the main body portion 212. Consequently, the second moveable brace 148 has a generally U-shaped profile when viewed in cross section taken orthogonal to the length of the second moveable brace 148.

The parallelogram-shaped cross-sectional profile of the upper and lower engagement portions 214 and 216 also results in a longitudinal surface of each of the upper and lower engagement portions extending at an angle or slope with respect to the adjacent first major surface 218 of the main body portion 212. The upper and lower engagement portions 214 and 216 are thus configured to be received and retained within the first and second grooves 158 and 160 of the main body 136. Although the first and second grooves 158 and 160 and the upper and lower engagement portions 214 and 216 are shown with complementary angled or sloped surfaces, other complementary shapes or configurations of the grooves and the upper and lower engagement portions are possible to allow the upper and lower engagement portions to be received and retained in the grooves. As can be seen, each of the upper and lower engagement portions 214 and 216 includes two, spaced apart, raised mating portions 222. The raised mating portions 222 contact the surfaces of the main body 136 inside the first and second grooves 158 and 160 and thereby reduce the extent to which the upper and lower engagement portions 200 and 202 contact those surfaces. The upper and lower engagement portions 214 and 216 are thus configured to slide within the first and second grooves 158 and 160, respectively, of the main body 136. The second moveable brace 148 is thereby slidably mounted in the first bracket assembly 130.

Figure 7A:
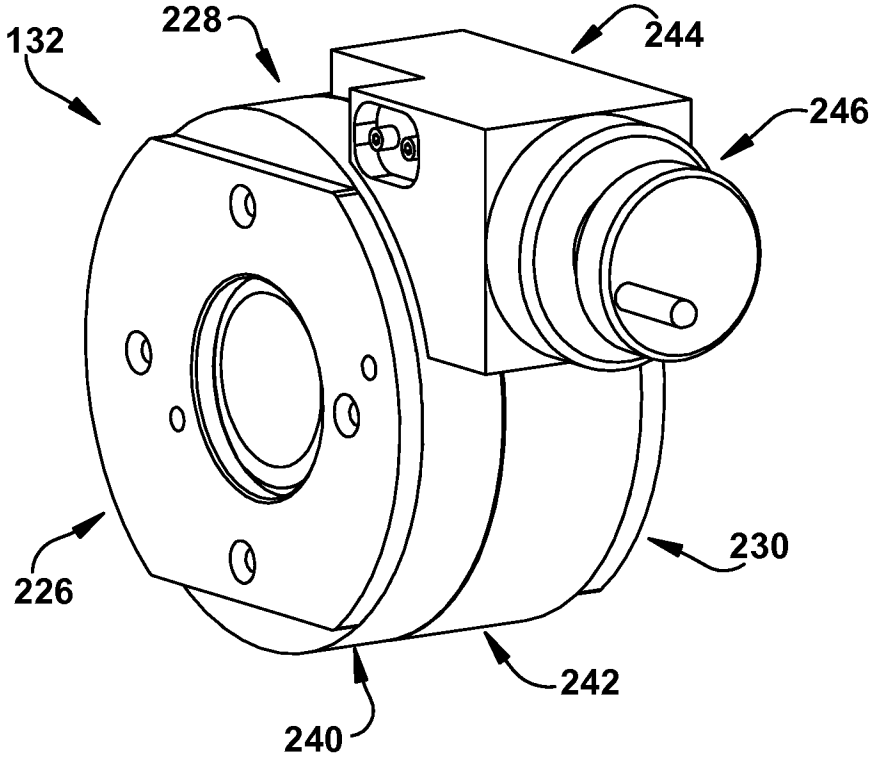
FIG. 7A is a perspective view showing a second bracket assembly included in the adjustment mechanism of FIGS. 5A-B.

The main body portion 212 of the second moveable brace 148 includes a relatively large diameter central opening 223 that is dimensioned to receive a portion of the first cylindrical slide element 167 so that the main body portion 212 and the second moveable brace 148 move together with the first slide element. The main body portion 212 also includes smaller diameter fastener openings 224 that extend through the main body portion from the first major surface 218 to the second major surface 206. The fastener openings 224 are configured and dimensioned to receive fasteners (not shown) that extend into the fastener openings 54 in the upper portion 48 of the second connecting bracket 90 to mount the first connecting bracket to the second moveable brace 148. The main body portion 212 may include a raised mating portion (not shown) that extends from the first major surface 218. The raised mating portion may be shaped and dimensioned to fit within or mate with the central opening 96 of the second connecting bracket 90 of the first head support 14. In one example, the raised mating portion may have a dome-like configuration The second bracket assembly 132 (FIGS. 7A-B) is operable to effect or cause pivotal movement of the first and second head supports 14 and 16 relative to the longitudinal plane LP and the central longitudinal axis 17. The second bracket assembly 132 is operably connected to the first bracket assembly 130 and, through the first bracket assembly, to both of the first and second head supports 14 and 16. The second bracket assembly 132 includes a first connecting plate 226, a gear subassembly 228, and a second connecting plate 230.

The second bracket assembly 132 is connected to the first bracket assembly 130 by the first connecting plate 226. The first connecting plate 226 has a generally circular shape with two opposed flattened edges. It will be appreciated that the first connecting plate 226 can have other shapes (e.g., triangular or rectangular). The first connecting plate 226 (FIG. 7B) includes a first major surface 232 and an oppositely disposed second major surface 234. The first major surface 232 is presented toward and is configured to engage the back surface 156 of the main body 136 of the first bracket assembly 130. The second major surface 234 is presented toward and is configured to engage a portion of the gear subassembly 228.

The first connecting plate 226 includes one or more openings 235 that extend through the first connecting plate from the first major surface 232 to the second major surface 234. Each of the openings 235 is configured and dimensioned to receive a fastener (not shown), such as a screw, bolt or pin, for connecting the main body 136 of the first bracket assembly 130 with the first connecting plate 226. The fasteners (not shown) extend from one or more of the openings 166 formed in the main body 136 of the first bracket assembly 130. The first connecting plate 226 also includes one or more openings 236 that extend through the first connecting plate from the first major surface 232 to the second major surface 234. Each of the openings 236 is configured and dimensioned to receive a fastener (not shown), such as a screw, bolt or pin, for connecting the first connecting plate 226 with the gear subassembly 228 of the second bracket assembly. The first connecting plate 226 further includes a large diameter central opening 238 dimensioned to receive a support element (not shown).

The gear subassembly 228 of the second bracket assembly 132 includes a rotatable transfer plate 240, a worm gear subassembly 242, a worm subassembly 244, and a second control knob 246. The rotatable transfer plate 240 has a circular outer shape, but may have other shapes (e.g., oval, triangular or rectangular). The rotatable transfer plate 240 includes a first surface 248 and an oppositely disposed second surface (not shown), which contacts and is engaged with a portion of the worm gear subassembly 242. The first surface 248 is presented toward and configured to engage the second major surface 234 of the first connecting plate 226. The rotatable transfer plate 240 includes one or more openings 250. Each opening 250 is disposed to align with a corresponding opening 236 in the first connecting plate 226. Each of the openings 250 is configured and dimensioned to receive a fastener (not shown), such as a screw, bolt or pin, that extends from a corresponding opening 236 for connecting the first connecting plate 226 with the gear subassembly 228 of the second bracket assembly 132. The rotatable transfer plate 240 further includes a substantially larger diameter central opening 252 dimensioned to receive a support element (not shown).

Figure 7B:
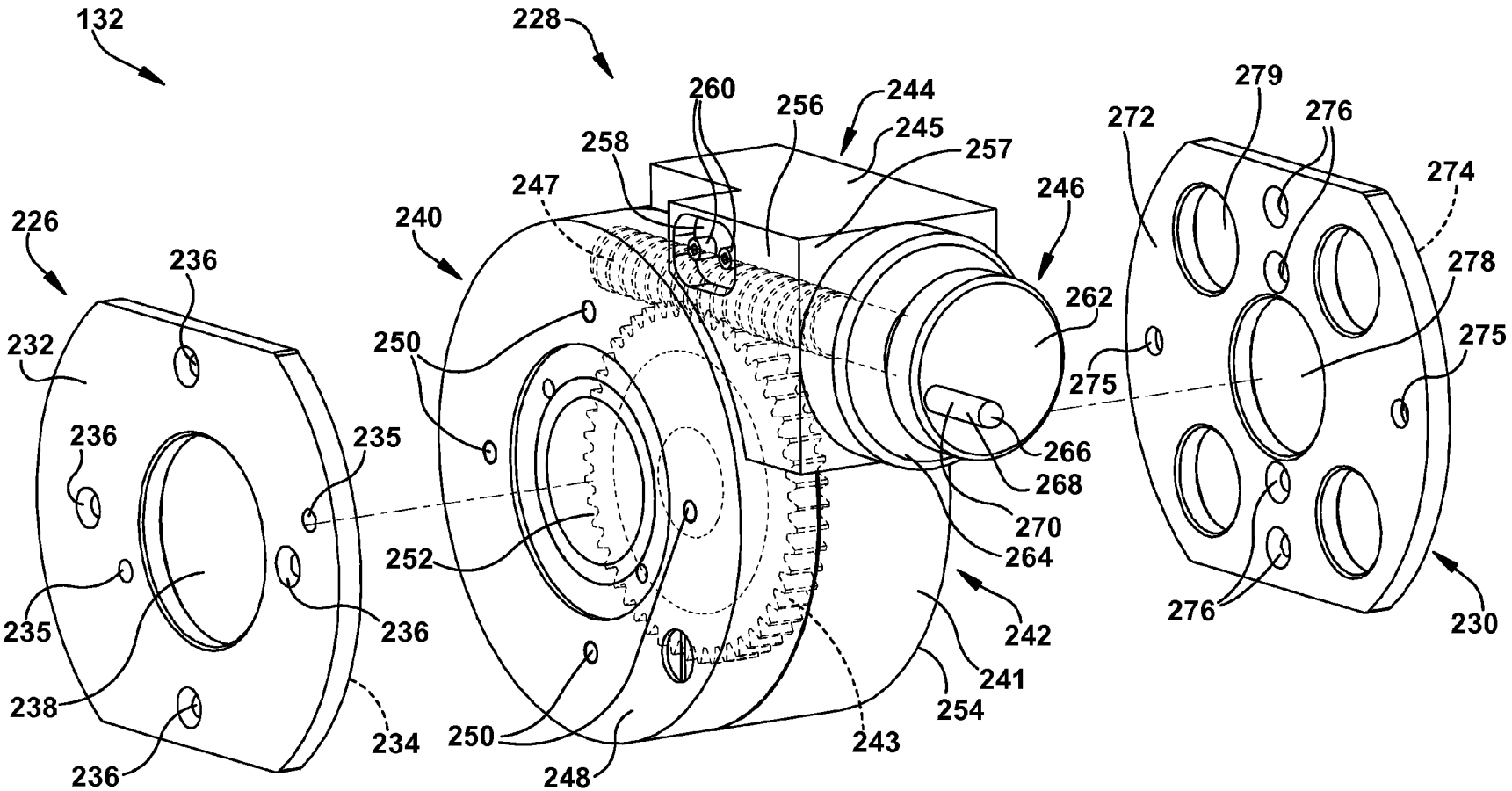
FIG. 7B is an exploded perspective view of the second bracket assembly of FIG. 7A.

As shown in FIG. 7B, the worm gear subassembly 242 is operably connected to the rotatable transfer plate 240 and is also connected to the second connecting plate 230. The worm gear subassembly 242 includes an outer housing 241 and a worm gear 243 within the outer housing 241. The outer housing 241 has a circular outer shape, but can have other shapes (e.g., triangular or rectangular). The worm gear 243 has a surface (not shown) that contacts and is connected for rotation with the rotatable transfer plate 240. The outer housing 241 has a surface 254 presented away from the rotatable transfer plate 240 and toward the second connecting plate 230. The surface 254 includes openings (not shown) configured and dimensioned to receive fasteners (not shown) to attach the second connecting plate 230 to the outer housing 241 of the worm gear subassembly 242. Although not shown, the worm gear subassembly 242 also includes a central opening that is in communication with the central opening 252 of the rotatable transfer plate 240.

The worm subassembly 244 includes an outer housing 245 and a worm 247 within the outer housing 245. The outer housing 245 of worm subassembly 244 has a generally rectangular outer shape, but may have other shapes. The worm 247 is operably connected to and engaged with the worm gear 243 such that rotation of the worm effects or produces rotation of the worm gear. The worm 247 and worm gear 243 thus comprise a gear assembly. One end of the worm 247 is operably connected to the second control knob 246 such that rotation of the second control knob effects or produces rotation of the worm. A surface 256 of the outer housing 245 of the worm subassembly 244 includes a depression 258 in which connecting members 260 are disposed.

The second control knob 246 includes a top portion 262, a bottom portion 264 connected to the worm 247 of the worm subassembly 244, and a second handle 266 attached to the top portion. The bottom portion 264 of the second control knob 246 has a circular cross-sectional profile and contacts a second surface 257 of the outer housing 245 of the worm subassembly 244. The second handle 266 includes a top portion 268 and a bottom portion 270, which is attached to the top portion 262 of the second control knob 246. As discussed in more detail below, rotation of the second control knob 246 causes the first bracket assembly 130 to pivot relative to the longitudinal plane LP and a central longitudinal axis of the first bracket assembly.

Figure 5A:
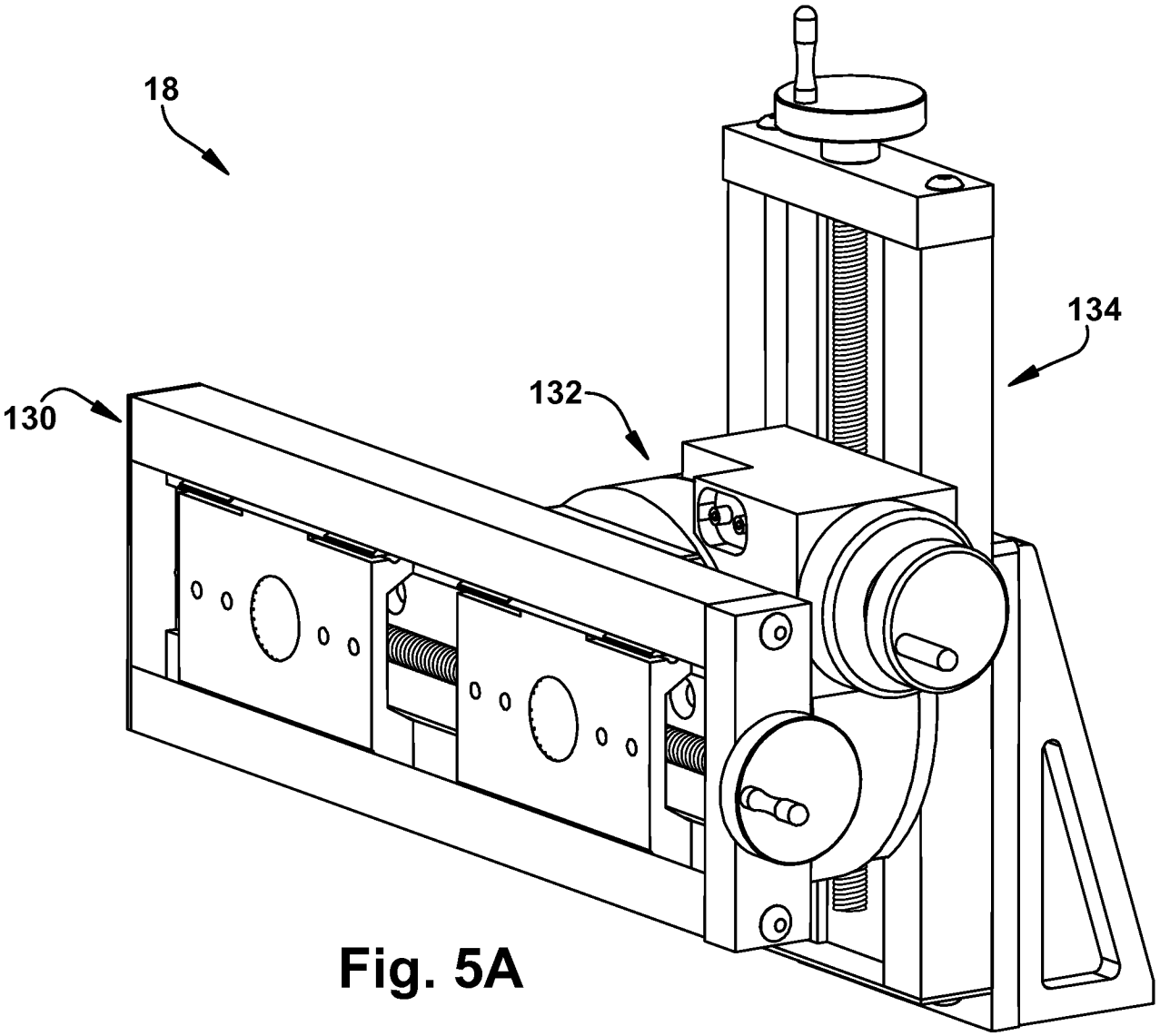
FIG. 5A is a perspective view showing an adjustment mechanism of the headrest assembly of FIGS. 1A-B.
Figure 5B:
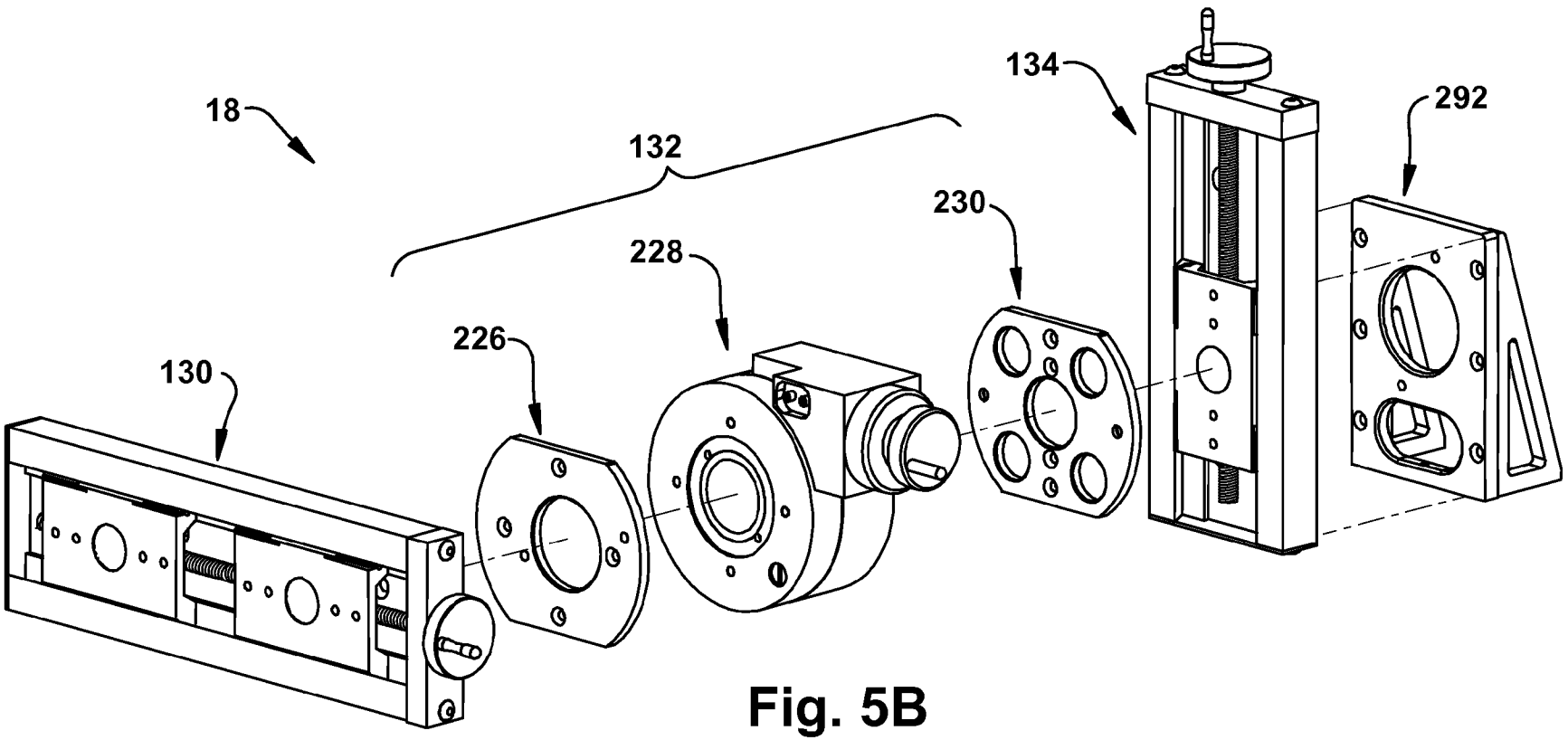
FIG. 5B is an exploded perspective view of the adjustment mechanism of FIG. 5A.

The second connecting plate 230 (FIG. 7B) of the second bracket assembly 132 connects the second bracket assembly to the third bracket assembly 134. The second connecting plate 230 is similar in shape to the first connecting plate 226. The second connecting plate 230 includes a first major surface 272 that is configured to engage the surface 254 of the outer housing 241 of the worm gear subassembly 242. The second connecting plate 230 has a second major surface 274 that is configured to engage a portion of the third bracket assembly 134 (FIGS. 5A-B). The second connecting plate 230 includes one or more openings 275 that extend through the second connecting plate from the first major surface 272 to the second major surface 274. Each of the openings 275 is configured and dimensioned to receive a fastener (not shown), such as a screw, bolt or pin, for connecting the second connecting plate to the outer housing 241 of the worm gear subassembly 242. The fasteners extend from one or more of the openings (not shown) formed in the surface 254 of the outer housing 241 of the worm gear subassembly 242. The second connecting plate 230 also includes one or more openings 276 that extend through the second connecting plate from the first major surface 272 to the second major surface 274. Each of the openings 276 is configured and dimensioned to receive a fastener (not shown), such as a screw, bolt or pin, for connecting the second connecting plate 230 with a portion of the third bracket assembly. The second connecting plate 230 further includes a substantially larger diameter central opening 278 that extends between the first and second surfaces 272 and 274. The central opening 278 is in communication with the central opening 252 of the rotatable transfer plate 240 and the central opening 238 of the first connecting plate 226. Additionally, the second connecting plate 230 includes relatively large openings 279 to help, for example, reduce the weight of the second connecting plate.

Figure 8A:
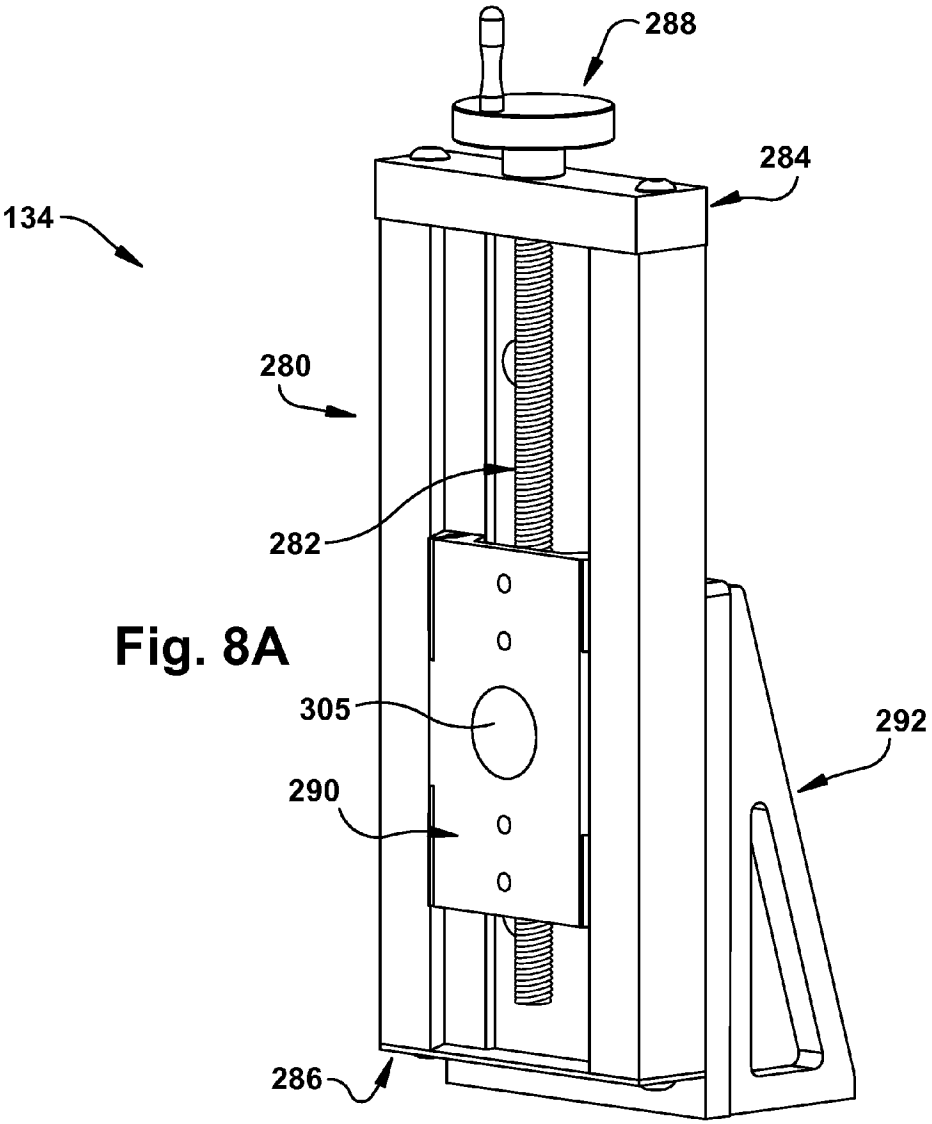
FIG. 8A is a perspective view of a third bracket assembly included in the adjustment mechanism in FIGS. 5A-B.
Figure 8B:
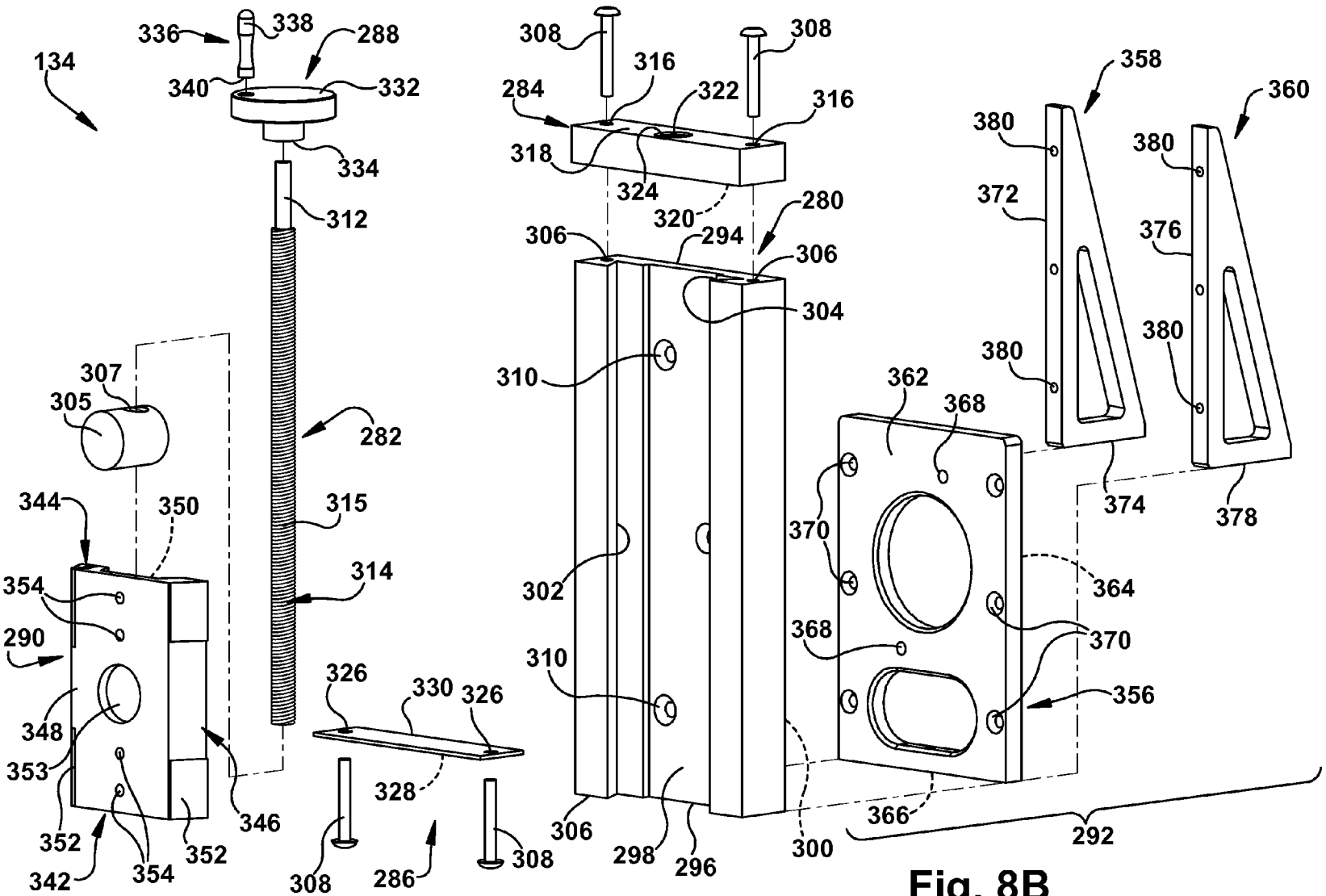
FIG. 8B is an exploded perspective view of the third bracket assembly of FIG. 8A.

The third bracket assembly 134 (FIGS. 8A-B) is operable to effect or cause translation of the first and second head supports 14 and 16 in a direction parallel to the axial plane AP and central vertical axis 19. The third bracket assembly 134 is operably connected to the second bracket assembly 132 and, through the second bracket assembly, to the first bracket assembly 130 and to both of the first and second head supports 14 and 16. The third bracket assembly 134 (FIG. 8B) includes a main body 280, a second threaded shaft 282, a first end plate 284, a second end plate 286, a third control knob 288, a moveable brace 290, and a connecting bracket 292 (FIG. 8A). The third bracket assembly 134 is attached to the frame 12.

The main body 280 (FIG. 8B) has a rectangular shape; although other shapes (e.g., square, oval or circular) are possible. The main body 280 includes a first end 294, an oppositely disposed second end 296, a front surface 298, and a back surface 300. The first end 294 is configured to engage the first end plate 284, and the second end 296 is configured to engage the second end plate 286. Each of the first end 294 and the second end 296 includes openings 306 configured and dimensioned to receive fasteners 308 (e.g., screws, bolts or pins). The front surface 298 includes first and second grooves 302 and 304 configured and dimensioned to receive and engage edges of the moveable brace 290. The front surface 298 is also configured to contact and provide a slide surface for a cylindrical slide element 305 that engages and moves along the second threaded shaft 282. The back surface 300 of the main body 280 is configured to engage a portion of the connecting bracket 292. The main body 280 further includes one or more openings 310 extending through the main body from the front surface 298 to the back surface 300. Each of the openings 310 is configured and dimensioned to receive a fastener (not shown) for connecting the main body 280 to a portion of the connecting bracket 292.

The second threaded shaft 282 has an elongated cylindrical shape and is disposed along and substantially parallel to the front surface 298 of the main body 280. The second threaded shaft 282 includes a relatively short first end portion 312 and a substantially longer second end portion 314. The first end portion 312 has an outer diameter that is less than an outer diameter of the second end portion 314. The first end portion 312 is configured and dimensioned to extend through the first end plate 284 and engage the third control knob 288 such that the first end portion is operably connected to the first control knob. The second end portion 314 has an external threaded surface 315. The second end portion 314 extends through an opening 307 in the cylindrical slide element 305. The opening 307 in the cylindrical slide element 305 is defined by an internal threaded surface of the slide element.

The external threaded surface 315 of the second end portion 314 of the second threaded shaft 282 engages the internal threaded surface of the cylindrical slide element 305 so that rotation of the second threaded shaft 282 effects or causes movement of the cylindrical slide element 305 along the length of the second end portion. As a result of the first end portion 312 of the second threaded shaft 282 being operably connected to the third control knob 288, the second threaded shaft rotates about its central longitudinal axis in response to rotation of the third control knob.

The first end plate 284 is configured to engage the first end 294 of the main body 280. The first end plate 284 has a rectangular outer shape, but it will be appreciated that other shapes are possible (e.g., square, oval or circular). The first end plate 284 includes one or more fastener openings 316, each of which extends through the first end plate from a first surface 318 of the first end plate to an opposite, parallel second surface 320 of the first end plate. Between them, the first and second surfaces 318 and 320 define the thickness of the first end plate 284. Each of the fastener openings 316 is configured and dimensioned to receive one of the fasteners 308. Each of the fasteners 308 extends through the fastener openings 316 into the openings 306 in the first end 294 of the main body 280 to join the first end plate 284 with the main body. The first end plate 284 also includes a central opening 322 that extends through the first end plate from the first surface 318 to the second surface 320. The central opening 322 is configured and dimensioned to receive the first end portion 312 of the second threaded shaft 282. A portion of the first surface 318 surrounding the central opening 322 includes a depression 324, which receives a portion of the third control knob 288.

The second end plate 286 is configured to engage the second end 296 of the main body 280. The second end plate 286 has a rectangular outer shape, but it will be appreciated that other shapes are possible (e.g., square, oval or circular). The second end plate 286 includes one or more fastener openings 326, each of which extends through the second end plate from a first surface 328 of the second end plate to an opposite, parallel second surface 330 of the second end plate. Between them, the first and second surfaces 328 and 330 define the thickness of the second end plate 286. Each of the fastener openings 326 is configured and dimensioned to receive one of the fasteners 308. Each of the fasteners 308 extends through the fastener openings 326 into the openings 306 of the second end 296 of the main body 280 to join the second end plate 286 with the main body.

The third control knob 288 includes a top portion 332, a bottom portion 334, and a third handle 336 attached to the top portion. The third handle 336 includes a top portion 338 and a bottom portion 340. The bottom portion 340 of the third handle 336 is attached to the top portion 332 of the third control knob 288. The bottom portion 340 of the third control knob 288 has a circular cross-sectional profile and is configured to fit snugly within the depression 324 surrounding the central opening 322 in the first end plate 284. The bottom portion 340 of the third control knob 288 also includes an elongated internal surface (not shown) that defines a passage to receive the first end portion 312 of the second threaded shaft 282 such that the third control knob is non-rotatably attached to and can rotate the second threaded shaft. The attachment of the third control knob 288 to the first end portion 312 of the second threaded shaft 282 can be obtained via a force fit, an adhesive, a set screw, or any other appropriate mechanism or technique. The third control knob 288 is thus operably connected to the second threaded shaft 282.

The moveable brace 290 includes a main body portion 342 that has a generally rectangular shape. The main body portion 342 has a longer dimension that extends in a direction parallel to the axial plane AP and the central vertical axis 19 and a shorter dimension that extends in a direction parallel to the longitudinal plane LP and the central longitudinal axis 17. Oppositely disposed left and right (as viewed in FIG. 8B) engagement portions 344 and 346 of the moveable brace 290 extend along left and right longitudinal edges of the main body portion 342 and are spaced apart by the shorter dimension of the rectangularly shaped main body portion. The left engagement portion 344 can flex or pivot about a longitudinal axis relative to the main body portion 342. The main body portion 342 has a flattened or planar configuration and includes oppositely disposed first and second major surfaces 348 and 350. The first major surface 348 is presented toward the second major surface 274 of the second connecting plate 230. The second major surface 350 is presented toward the main body 280. Each of the left and right engagement portions 344 and 346 has a parallelogram-shaped cross-sectional profile and is thicker than the main body portion 342. Consequently, the moveable brace 290 has a generally U-shaped profile when viewed in cross section taken orthogonal to the length of the moveable brace 290.

The parallelogram-shaped cross-sectional profile of the left and right engagement portions 344 and 346 also results in a longitudinal surface of each of the left and right engagement portions extending at an angle or slope with respect to the adjacent first major surface 348 of the main body portion 342. The left and right engagement portions 344 and 346 are thus configured to be received and retained within the first and second grooves 302 and 304 of the main body 280. Although the first and second grooves 302 and 304 and the left and right engagement portions 344 and 346 are shown with complementary angled or sloped surfaces, other complementary shapes or configurations of the grooves and the left and right engagement portions are possible to allow the left and right engagement portions to be received and retained in the grooves. As can be seen, each of the left and right engagement portions 344 and 346 includes two, spaced apart, raised mating portions 352. The raised mating portions 352 contact the surfaces of the main body 280 inside the first and second grooves 302 and 304 and thereby reduce the extent to which the left and right engagement portions 344 and 346 contact those surfaces. The left and right engagement portions 344 and 346 are thus configured to slide within the first and second grooves 302 and 304, respectively, of the main body 280. The moveable brace 290 is thereby slidably mounted in the third bracket assembly 134.

The main body portion 342 of the moveable brace 290 includes a relatively large diameter central opening 353 that is dimensioned to receive a portion of the cylindrical slide element 305 so that the main body portion 342 and the moveable brace 290 move together with the cylindrical slide element. The main body portion 342 also includes smaller diameter fastener openings 354 that extend through the main body portion from the first major surface 348 to the second major surface 350. The fastener openings 354 are configured and dimensioned to receive fasteners (not shown) that extend into the fastener openings (not shown) in the second major surface 274 of the second connecting plate 230 to mount the gear subassembly 228 to the moveable brace 290. The main body portion 342 may include a raised mating portion (not shown) that extends from the first major surface 348. The raised mating portion may be shaped and dimensioned to fit within or mate with an opening (not shown) in the second major surface 274 of the second connecting plate 230. In one example, the raised mating portion may have a dome-like configuration The connecting bracket 292 (FIG. 8A) is configured to connect the third bracket assembly 134 to the frame 12. The connecting bracket 292 (FIG. 8B) includes a base plate 356, a first support member 358, and a second support member 360. The base plate 356 has a rectangular shape and includes a front surface 362, a rear surface 364, and a bottom surface 366. The front surface 362 is presented toward the back surface 300 of the main body 280. The back surface 364 is presented toward the first and second support members 358 and 360. The front surface 362 is configured to mate with the back surface 300 of the main body 280. The base plate 356 includes openings 368 that extend through the base plate from the front surface 362 to the back surface 364. The openings 368 are configured and dimensioned to receive fasteners (not shown) to attach the base plate to the main body 280. The openings 368 are positioned so as to be aligned with at least some of the openings 310 in the main body 280 and therefore receive fasteners that extend from those openings 310. The base plate 356 also includes openings 370 that extend through the base plate from the front surface 362 to the back surface 364. The openings 370 are configured dimensioned to receive fasteners for attaching the base plate to the first and second support members 358 and 360.

The first and second support members 358 and 360 are configured to support the base plate 356 and to connect the third bracket assembly 134 to the frame 12. The first and second support members 358 and 360 have a triangular outer shape, but the first and second support members can have other shapes (e.g., square or rectangular). The first support member 358 includes a front surface 372 and a bottom surface 374. The second support member 360 includes a front surface 376 and a bottom surface 378. The front surface 372 of the first support member 358 and the front surface 376 of the second support member 360 contact or otherwise engage the rear surface 364 of the base plate 356. Each of the front surfaces 372 and 376 of the first and second support members 358 and 360 includes one or more openings 380 configured and dimensioned to receive fasteners (not shown) to connect the first and second support members to the base plate 356. The openings 370 are positioned so as to be aligned with the openings 370 in the base plate 356. The first and second support members 358 and 360 are connected to the base plate 356 so that the bottom surface 366 of the base plate, the bottom surface 374 of the first support member 358, and the bottom surface 378 of the second support member 360 are substantially coplanar with one another. The bottom surface 366 of the base plate 356, the bottom surface 374 of the first support member 358, and the bottom surface 378 of the second support member 360 are connected to the attachment portion 38 of the second segment 22 of the frame 12 using fasteners (not shown), such as screws, bolts or pins, or other attachment devices, such as clamps.

Figure 9:
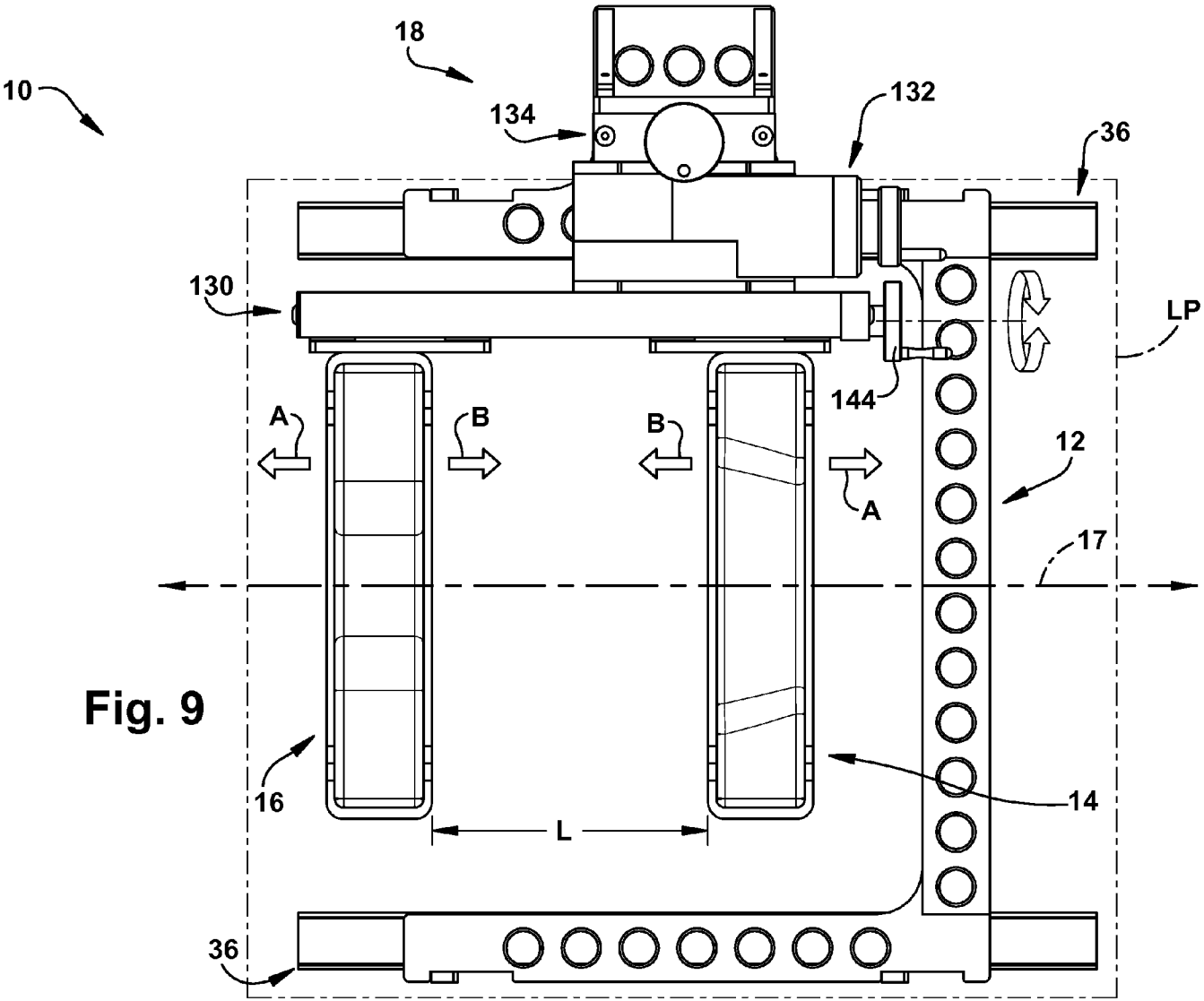
FIG. 9 is a top view showing displacement of the first and second head supports along a longitudinal plane of the headrest assembly of FIGS. 1A-B.
Figure 10:
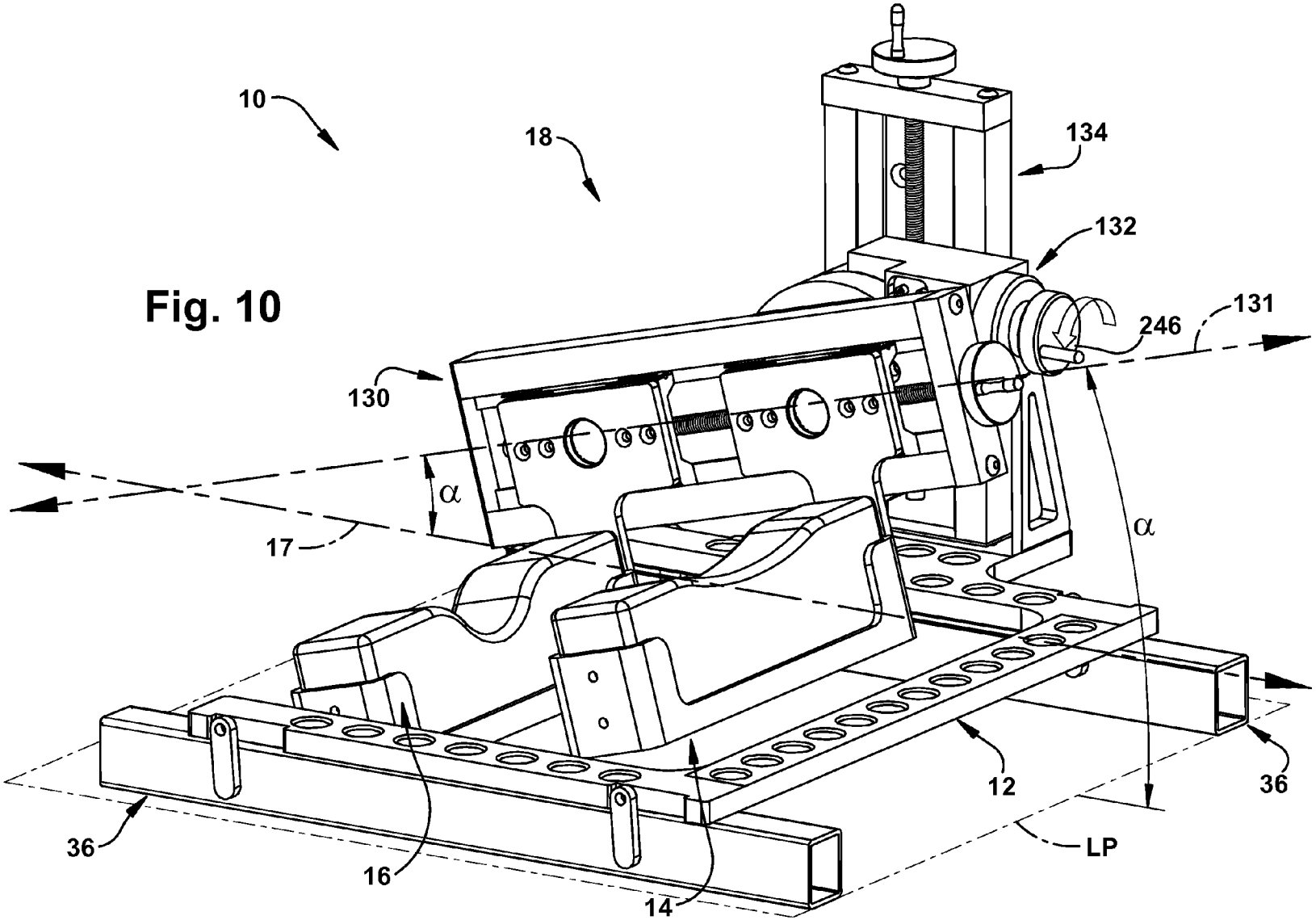
FIG. 10 is a perspective view showing pivotal adjustment of the first and second head supports of the headrest assembly of FIGS. 1A-B.
Figure 11:
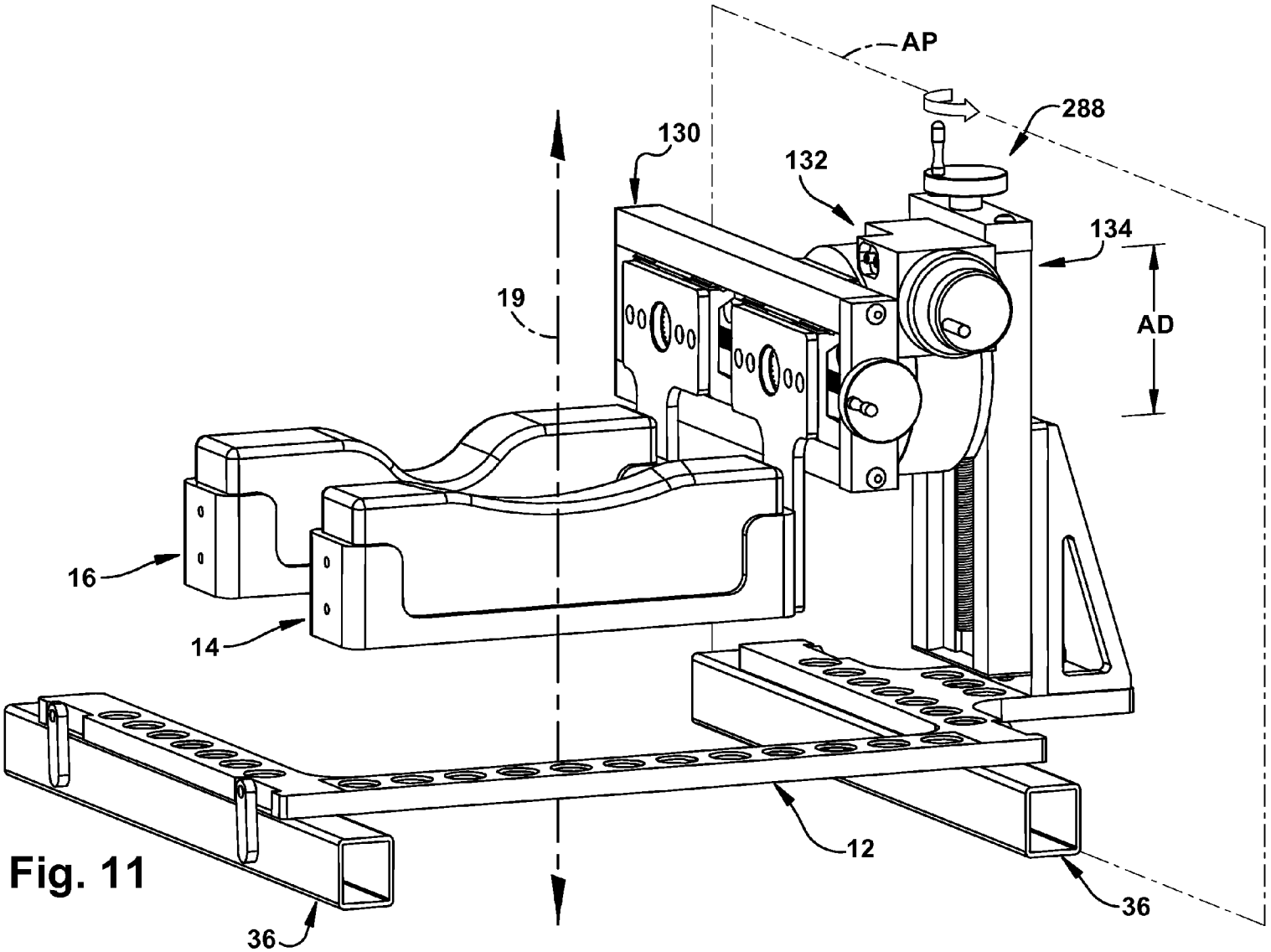
FIG. 11 is a perspective view showing displacement of the first and second head supports along an axial plane of the headrest assembly in FIGS. 1A-B.

Operation of the headrest assembly 10 is illustrated in FIGS. 9-11. The headrest assembly 10 is configured so that the first and second head supports 14 and 16 include at least two degrees of freedom (e.g., first and second degrees of freedom) relative to the longitudinal plane LP and the central longitudinal axis 17 and one degree of freedom (e.g., a third degree of freedom) relative to the axial plane AP and the vertical central axis 19.

The first degree of freedom (FIG. 9) relates to the ability of the first and second head supports 14 and 16 to move in directions parallel to the longitudinal plane LP and the central longitudinal axis 17. In particular, the first and second head supports 14 and 16 are shown in FIG. 9 being separated or spaced apart from each other by a distance L along the longitudinal plane LP and the central longitudinal axis 17. The distance L can be increased or decreased, as indicated by the arrows A and B, by rotating the first control knob 144 of the first bracket assembly 130. Rotation of the first control knob 144 produces rotation of the first threaded shaft 138 and movement of the first and second cylindrical slide elements 165 and 167 along the first threaded shaft. Movement of the first and second cylindrical slide elements 165 and 167 causes movement of the first and second moveable braces 146 and 148 and corresponding movement of the first and second head supports 14 and 16 toward or away from one another. It will be appreciated that because the external threaded surface 169 of the second end portion 170 of the first threaded shaft 138 has a right-hand thread over approximately one-half of its length and a left-hand thread over the other half of its length, the first and second head supports 14 and 16 must both move toward and away from each other as the first control knob 144 is rotated. Nonetheless, the first bracket assembly 130 could be designed such that the first head support 14 remains stationary while the second head support 16 is moved. Alternatively, the first bracket assembly 130 could be designed such that the second head support 16 remains stationary while the first head support 14 is moved.

The second degree of freedom relates to the ability of the first and second head supports 14 and 16 to pivot through an angle $\alpha$ (FIG. 10) measured between the longitudinal axis 131 of the first bracket assembly 130 and the longitudinal plane LP and central longitudinal axis 17. The angle $\alpha$ can be selected by rotating the second control knob 246 of the second bracket assembly 132. Rotation of the second control knob 246 causes rotation of the worm 247 of the second bracket assembly 132, which, in turn, produces rotation of the worm gear 243 and the rotatable transfer plate 240 and the first connecting plate 226. Rotation of the first connecting plate 226 causes pivotal movement of the first bracket assembly 130 and the first and second head supports 14 and 16 attached to the first bracket assembly. Consequently, the first bracket assembly 130 can pivot upward or downward relative to the longitudinal plane LP and the central longitudinal axis 17.

The third degree of freedom relates to the ability of the first and second head supports 14 and 16 in directions parallel to the axial plane AP and the central vertical axis 19. The first and second head supports 14 and 16 are shown in FIG. 11 being positioned at a distance above the frame 12, which is the maximum height at which the head supports may be positioned above the frame. In particular, the second bracket assembly 132 is shown in FIG. 11 at its maximum vertical position because the moveable brace 290 of the third bracket assembly 134, to which the second bracket assembly is attached, is at the end of its travel along the second threaded shaft 282 of the third bracket assembly 134. Rotation of the third control knob 288 will produce rotation of the second threaded shaft 282 and movement of the moveable brace 290 along the shaft toward the frame 12 through a maximum vertical distance AD, which maximum vertical distance is determined by interference between the frame and the first and/or second bracket assemblies 130 and 132. Rotation of the third control knob 288 in the opposite direction will then produce movement of the moveable brace 290 away from the frame 12 until the second bracket assembly 132 is again at its maximum vertical position shown in FIG. 11. Such movements of the moveable brace 290 and the second bracket assembly 132 will produce corresponding movements of the first bracket assembly 130 and the first and second head supports 14 and 16, all which are attached, directly or indirectly, to the second bracket assembly.

Figure 12A:
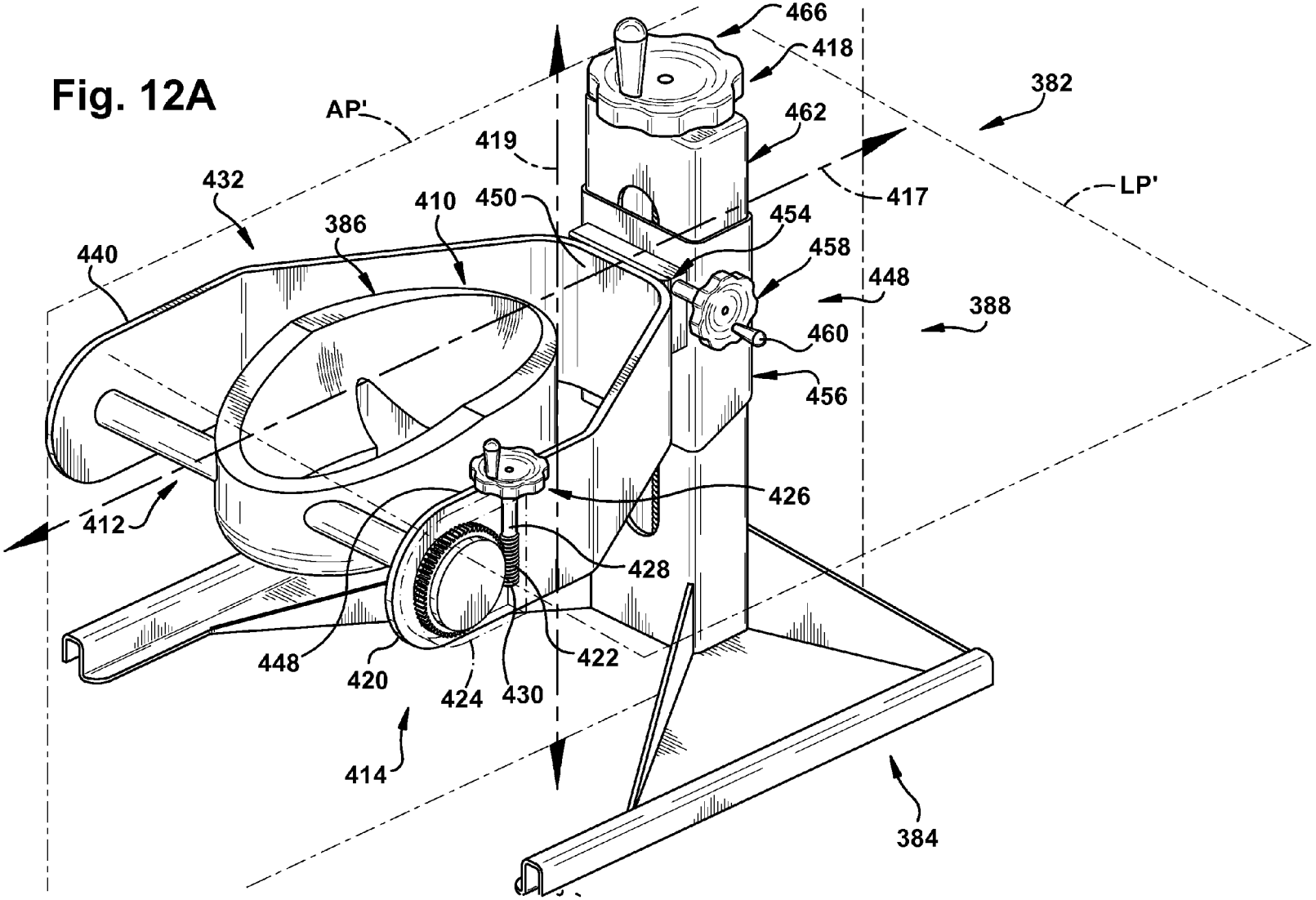
FIG. 12A is a perspective view showing a headrest assembly constructed in accordance with another embodiment of the present invention.
Figure 12B:
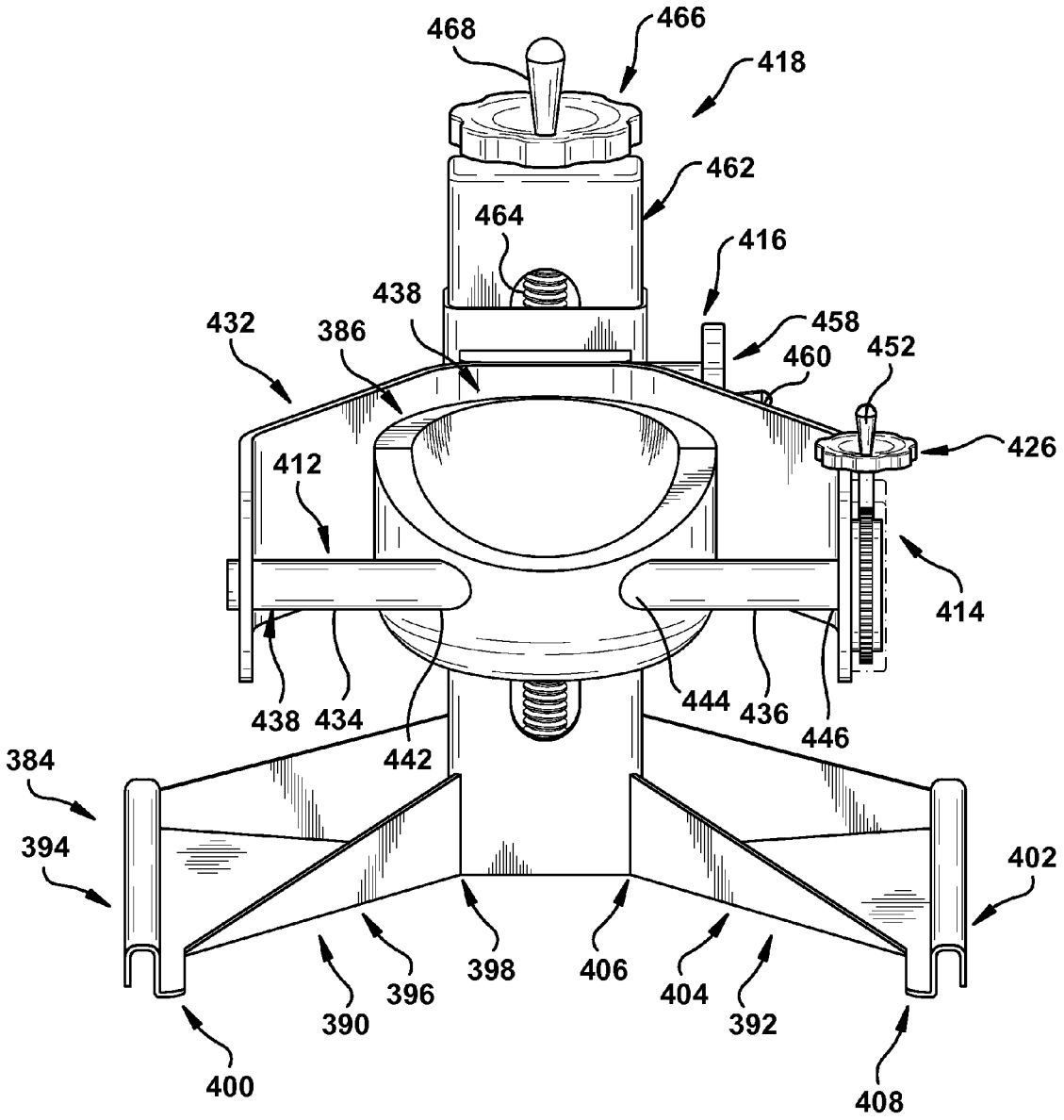
FIG. 12B is a perspective view taken from the front of the headrest assembly in FIG. 12A.
Figure 12C:
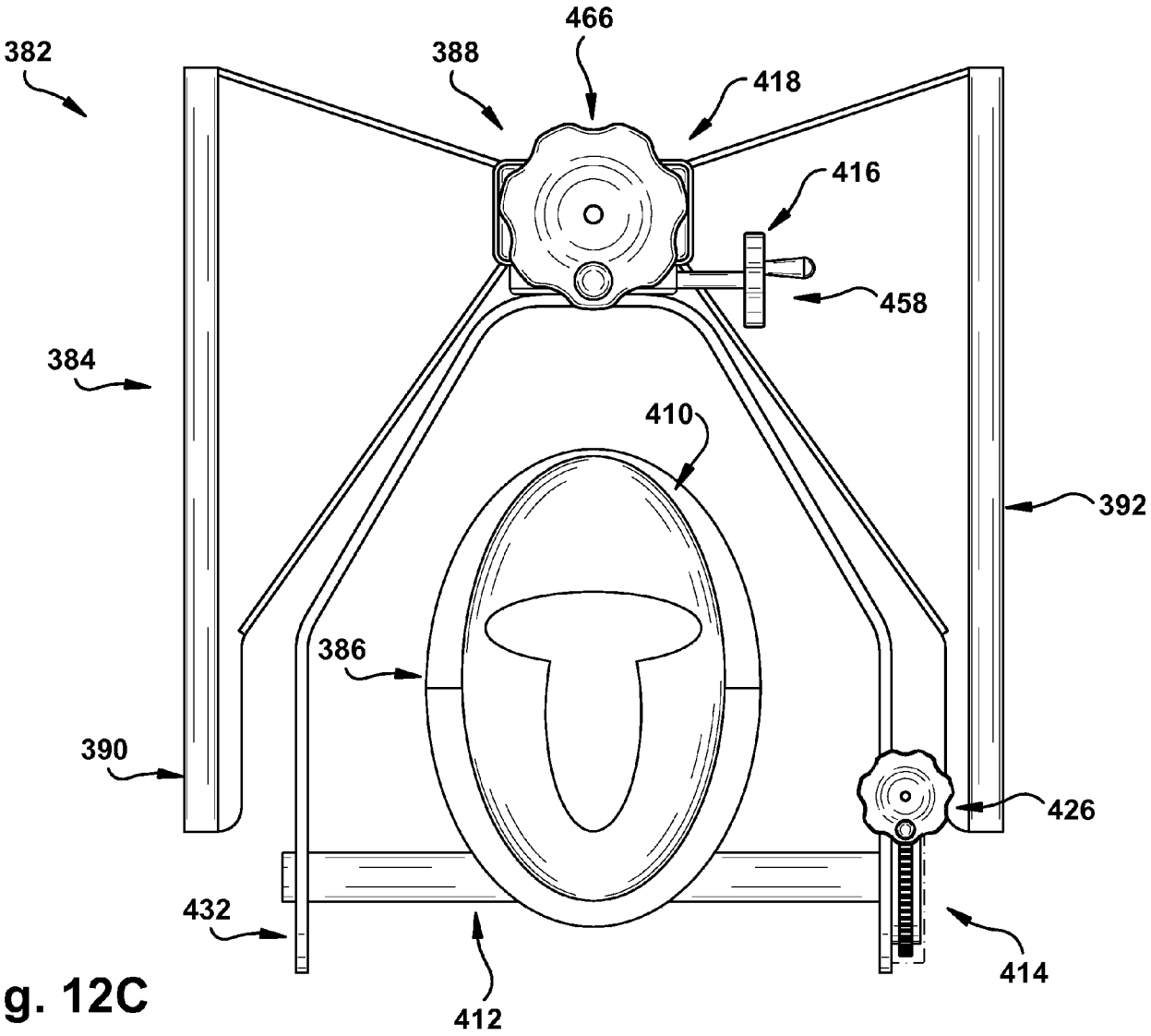
FIG. 12C is a top view of the headrest assembly in FIG. 12B.

In another embodiment of the present invention, FIGS. 12A-C show a headrest assembly 382 comprising a frame 384, a head support 386, and an adjustment mechanism 388. The frame 384 includes first and second portions 390 and 392 that are connected to a portion of the adjustment mechanism 388 and that are configured to engage an external structure (not shown). The first portion 390 of the frame 384 includes a mating portion 394 that is configured to mate with the external structure. The first portion 390 also includes a connecting portion 396 that extends between a first end 398 and a second end 400. The second portion 392 includes a mating portion 402 that is configured to mate with the external structure. The second portion 392 also includes a connecting portion 404 that extends between a first end 406 and a second end 408.

The head support 386 is configured to support the forehead and chin of a patient. The head support 386 can be made of a soft material, such as a foam or gel. The head support 386 includes a main body 410 having a bowl-like configuration. The head support 386 has portions cut out to accommodate the nose and a portion of the patient's forehead. The head support 386 is operably connected to a portion of the adjustment mechanism 388 via a transverse connecting member 412. The head support 386 has at least two degrees of freedom (e.g., first and second degrees of freedom) relative to a longitudinal plane LP' and a central longitudinal axis 417 of the headrest assembly 382. The head support 386 has at least one degree of freedom (e.g., a third degree of freedom) relative to an axial plane AP' and a central vertical axis 419 of the headrest assembly 382.

The adjustment mechanism 388 is configured to adjust the position of the head support 386 relative to the longitudinal and axial planes LP' and AP', the central longitudinal axis 417, and the central vertical axis 419. The adjustment mechanism 388 includes a first bracket assembly 414, a second bracket assembly 416, and a third bracket assembly 418.

The first bracket assembly 414 is configured to adjust translation of the head support 386 in directions parallel to the longitudinal plane LP' and perpendicular to the central longitudinal axis 417. The first bracket assembly 414 includes a main body 420, a first threaded shaft 422, a gear mechanism 424, and a first control knob 426. The first threaded shaft 422 and the gear mechanism 424 are disposed within the main body 420. A first end 428 of the first threaded shaft 422 engages a portion of the first control knob 426, and a second end 430 of the first threaded shaft engages a portion of the gear mechanism 424. The first bracket assembly 414 is connected to the head support 386 by the transverse connecting member 412 and a connecting bracket 432. The transverse connecting member 412 includes first and second segments 434 and 436. A first end 438 of the first segment 434 is connected to a first end 440 of the connecting bracket 432, and a second end 442 of the first segment is connected to a portion of the head support 386. A first end 444 of the second segment 436 is connected to a portion of the head support 386. A second end 446 of the second segment 436 passes through an opening (not shown) in a second end 448 of the connecting bracket 432 and engages the gear mechanism 424.

As shown in FIG. 12A, the connecting bracket 432 includes the first end 440, the second end 448, which is oppositely disposed from the first end, and an intermediate portion 450 that joins together the first end and the second end. The first control knob 426 includes a first handle 452 to allow a user to rotate the first control knob. As the first control knob 426 is rotated, the first threaded shaft 422 and the gear mechanism 424 rotate, causing the head support 386 to be displaced along the length of the transverse connecting member 412.

The second bracket assembly 416 is configured to adjust axial displacement of the head support 386 relative to the longitudinal plane LP'. The second bracket assembly 416 includes a main body 454, a gear mechanism (not shown), a moveable brace 456, and a second control knob 458. A front surface (not shown) of the main body 454 engages a portion of the intermediate portion 450 of the connecting bracket 432. A rear surface (not shown) of the main body 454 engages the moveable brace 456. The moveable brace 456 engages a portion of the third bracket assembly 418. The second control knob 458 includes a second handle 460 to allow a user to rotate the second control knob. Rotation of the second control knob 458 causes the first bracket assembly 414 to rotate at an angle (not shown) relative to the longitudinal plane LP'.

The third bracket assembly 418 is configured to adjust translation of the head support 386 in a direction parallel to the axial plane AP' and the central vertical axis 419. The third bracket assembly 418 includes a main body 462, a second threaded shaft 464, and a third control knob 466. The second threaded shaft 464 is disposed within the main body 462. The main body 462 supports the moveable brace 456 of the second bracket assembly 416. The second threaded shaft 464 is operably connected the moveable brace 456. The third control knob 466 engages a portion of the second threaded shaft 464. The third control knob 466 includes a third handle 468 to allow a user to rotate the third control knob. An axial distance (not shown) between the head support 386 and the frame 384 can be adjusted upon rotation of the third control knob 466. As the third control knob 466 is rotated, the second threaded shaft 464 rotates, causing the moveable brace 456 to slide along the length of the second threaded shaft. Consequently, the head support 386 is axially displaced from the frame 384.

From the above description of the present invention, those skilled in the art will perceive improvements, changes, and modifications. For example, although the headrest assemblies 10 and 382 include adjustment mechanisms 18 and 388, respectively, that are manually operable using control knobs, small electric motors or other powered devices may be used in place of the manually operable control knobs. Such electric motors and other powered devices could be controlled via a stationary control panel or a hand-held control unit, either of which could connected via wires or wirelessly to the electric motors or other powered devices. Also, while the cushions 44 and 88 of the headrest assembly 10 are described as being made of gel, the cushions could be made of foam or a combination of gel and foam. The cushions 44 and 88 of the headrest assembly 10 and the head support 86 of the headrest assembly 382 may also have a more complex construction in which, for example, separate fluid bladders are inflated to different thicknesses or pressures to provide additional adjustments to fit the cushions and the head support to the contours of the patient's head. Further, it will be appreciated that one or more components of the headrest assembly 10 and 382 can be made of the same or different materials, such as a metal or metal alloy (e.g., stainless steel or aluminum) or a non-metal material (e.g., plastic). Such improvements, changes, and/or modifications are within the skill of the art and are intended to be covered by the appended claims.

What is claimed is:

1. A headrest assembly, comprising:

a frame;

a first head support configured and dimensioned to support a forehead of a patient;

a second head support configured and dimensioned to support a chin of the patient; and an adjustment mechanism mounted to the frame and operable to adjust a position of at least one of the first and second head supports relative to the frame, the first and second head supports having at least two degrees of freedom relative to a longitudinal plane and at least one degree of freedom relative to an axial plane that is orthogonal to the longitudinal plane, the longitudinal plane extending parallel to an X axis and also extending parallel to a Y axis that is orthogonal to the X axis, the axial plane extending parallel to one of the X axis and the Y axis, the axial plane also extending parallel to a Z-axis that is orthogonal to both the X axis and the Y axis, the adjustment mechanism including a first bracket assembly operably connected to both of the first and second head supports, the first bracket assembly being operable to effect translation of at least one of the first and second head supports in a direction parallel to the longitudinal plane, the first bracket assembly including a first rotatable threaded shaft, rotation of the first rotatable threaded shaft causing at least one of the first and second head supports to move across the first bracket assembly, a second bracket assembly operably connected to the first bracket assembly, the second bracket assembly including a gear assembly operable to effect pivotal movement of the first and second head supports relative to the longitudinal plane, and a third bracket assembly operably connected to the second bracket assembly, the third bracket assembly being operable to effect translation of the first and second head supports in a direction parallel to the axial plane, the third bracket assembly including a second rotatable threaded shaft, rotation of the second rotatable threaded shaft causing at least one of the first and second head supports to move in a direction parallel to the axial plane.

2. The headrest assembly of claim 1, wherein the frame has a U-shaped configuration and includes first and second segments joined together by an intermediate segment.

3. The headrest assembly of claim 2, wherein each of the first and second segments extends parallel to the longitudinal plane.

4. The headrest assembly of claim 2, wherein the frame further includes at least one attachment tab pivotable into a position extending perpendicular to the longitudinal plane.

5. The headrest assembly of claim 1, wherein each of the first and second head supports includes a receptacle member, a gel cushion disposed in the receptacle member, and a connecting bracket that joins each receptacle member to the adjustment mechanism.

6. The headrest assembly of claim 5, wherein each gel cushion of the first and second head supports is removably disposed within the respective receptacle member.

7. The headrest assembly of claim 1, wherein the gear assembly of the second bracket assembly includes a worm gear and a worm engaged with the worm gear.

8. A headrest assembly, comprising:

a frame;

a first head support configured and dimensioned to support a forehead of a patient;

a second head support configured and dimensioned to support a chin of the patient; and an adjustment mechanism mounted to the frame and operable to adjust a position of at least one of the first and second head supports relative to the frame, the first and second head supports having at least two degrees of freedom relative to a longitudinal plane and at least one degree of freedom relative to an axial plane that is orthogonal to the longitudinal plane, the longitudinal plane extending parallel to an X axis and also extending parallel to a Y axis that is orthogonal to the X axis, the axial plane extending parallel to one of the X axis and the Y axis, the axial plane also extending parallel to a Z-axis that is orthogonal to both the X axis and the Y axis the adjustment mechanism including a first bracket assembly operably connected to both of the first and second head supports, the first bracket assembly being operable to effect translation of at least one of the first and second head supports in a direction parallel to the longitudinal plane, a second bracket assembly operably connected to the first bracket assembly, the second bracket assembly being operable to effect pivotal movement of the first and second head supports relative to the longitudinal plane, and a third bracket assembly operably connected to the second bracket assembly, the third bracket assembly being operable to effect translation of the first and second head supports in a direction parallel to the axial plane, the first bracket assembly including a first rotatable threaded shaft and two movable braces, each movable brace supporting a different one of the first and second head supports, both of the movable braces being slidably mounted in the first bracket assembly.

9. The headrest assembly of claim 8, wherein the first bracket assembly includes a first control knob attached to the first rotatable threaded shaft, rotation of the first control knob effecting rotation of the first rotatable threaded shaft, rotation of the first rotatable threaded shaft causing at least one of the first and second head supports to move across the first bracket assembly.

10. The headrest assembly of claim 9, wherein the second bracket assembly includes:

a second control knob; and a gear assembly operably connected to the second control knob.

11. The headrest assembly of claim 10, wherein rotation of the second knob causes both of the first and second head supports to pivot relative to the longitudinal plane.

12. The headrest assembly of claim 11, wherein the third bracket assembly includes:

a second rotatable threaded shaft;

a third control knob attached to the second rotatable threaded shaft; and a movable brace member operably connected to the second bracket assembly, the movable brace member being slidably mounted in the third bracket assembly.

13. The headrest assembly of claim 12, wherein the first and second head supports are configured to move vertically upon rotation of the third control knob.

14. A headrest assembly, comprising:

a frame;

a first head support configured to support a forehead of a patient, the first head support including a first receptacle member, a first cushion disposed in the first receptacle member, and a first connecting bracket;

a second head support configured to support a chin of the patient, the second head support including a second receptacle member, a second cushion disposed in the second receptacle member, and a second connecting bracket; and an adjustment mechanism mounted to the frame and operable to adjust a position of at least one of the first and second head supports relative to the frame;

the first and second head supports having at least two degrees of freedom relative to a longitudinal plane and at least one degree of freedom relative to an axial plane that is orthogonal to the longitudinal plane, the longitudinal plane extending parallel to an X axis and also extending parallel to a Y axis that is orthogonal to the X axis, the axial plane extending parallel to one of the X axis and the Y axis, the axial plane also extending parallel to a Z-axis that is orthogonal to both the X axis and the Y axis, the first connecting bracket of the of the first head support joining the first receptacle member to the adjustment mechanism, the second connecting bracket of the second head support joining the second receptacle member to the adjustment mechanism, the adjustment mechanism including a first bracket assembly operably connected to each of the first and second connecting brackets, the first bracket assembly being operable to effect translation of at least one of the first and second head supports in a direction parallel to the longitudinal plane, the first bracket assembly including a first rotatable threaded shaft, a second bracket assembly operably connected to the first bracket assembly, the second bracket assembly being operable to effect pivotal movement of the first and second head supports relative to the longitudinal plane, the second bracket assembly including a gear assembly comprising a worm gear and a worm engaged with the worm gear, and a third bracket assembly operably connected to the second bracket assembly, the third bracket assembly being operable to effect translation of the first and second head supports in a direction parallel to the axial plane, the third bracket assembly including a second rotatable threaded shaft.

15. An adjustable headrest assembly for use in surgery during which a patient lies in a prone position, said adjustable headrest assembly comprising:

a U-shaped frame having first and second segments joined together by an intermediate segment, the frame having pivotable tabs to secure the headrest assembly to an external structure;

a forehead support and a chin support, each of the forehead support and the chin support including a receptacle member, a cushion disposed in the receptacle member, and a connecting bracket; and an adjustment mechanism mounted to the frame and attached to the connecting brackets of the forehead and chin supports, the adjustment mechanism being operable to adjust a position of the forehead and chin supports relative to the frame, the forehead and chin supports having at least two degrees of freedom relative to a longitudinal plane and at least one degree of freedom relative to an axial plane that is orthogonal to the longitudinal plane, the longitudinal plane extending parallel to an X axis and also extending parallel to a Y axis that is orthogonal to the X axis, the axial plane extending parallel to one of the X axis and the Y axis, the axial plane also extending parallel to a Z-axis that is orthogonal to both the X axis and the Y axis, the adjustment mechanism including a first bracket assembly operable to effect translation of at least one of the forehead and chin supports in a direction parallel to the longitudinal plane, the first bracket assembly including a first threaded shaft and a first control knob operably connected to the first threaded shaft, a second bracket assembly operably connected to the first bracket assembly and operable to effect pivotal movement of the forehead and chin supports relative to the longitudinal plane, the second bracket assembly including a gear assembly and a second control knob operably connected to the gear assembly, and a third bracket assembly operably connected to the second bracket assembly, the third bracket assembly being operable to effect translation of the forehead and chin supports in a direction parallel to the axial plane, the third bracket assembly including a second threaded shaft, a third control knob operably connected to the second threaded shaft, and a movable brace member operably connected to the second bracket assembly.

* * * * *